US010293605B2

(12) United States Patent
Ito

(10) Patent No.: US 10,293,605 B2
(45) Date of Patent: May 21, 2019

(54) LIQUID DISCHARGING DEVICE

(71) Applicant: BROTHER KOGYO KABUSHIKI KAISHA, Nagoya, Aichi (JP)

(72) Inventor: Tsuyoshi Ito, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/381,362

(22) Filed: Dec. 16, 2016

(65) Prior Publication Data

US 2017/0173947 A1 Jun. 22, 2017

(30) Foreign Application Priority Data

Dec. 18, 2015 (JP) ..... 2015-247200

(51) Int. Cl.
*B41J 2/165* (2006.01)
*B41J 2/045* (2006.01)

(52) U.S. Cl.
CPC ..... *B41J 2/04573* (2013.01); *B41J 2/04586* (2013.01)

(58) Field of Classification Search
None
See application file for complete search history.

(56) References Cited

U.S. PATENT DOCUMENTS

2013/0257948 A1 10/2013 Terada
2014/0204141 A1* 7/2014 Arakane ..... B41J 2/04508 347/14
2015/0029263 A1 1/2015 Arakane

FOREIGN PATENT DOCUMENTS

JP 2013-212586 A 10/2013
JP 2014-136419 A 7/2014
JP 2015-024602 A 2/2015

* cited by examiner

*Primary Examiner* — Alejandro Valencia
(74) *Attorney, Agent, or Firm* — Scully, Scott, Murphy & Presser, P.C.

(57) ABSTRACT

A liquid discharging device, including a liquid discharging head, a carriage, a carriage movement mechanism, a sheet conveyer, and a controller, is provided. The controller conducts a printing process, in which a path-printing operation and a conveying operation are repeated alternately for a plurality of times. The controller calculates discharging timing for the liquid discharging head to discharge the liquid in a path-printing operation, for an upstream area located on an upstream side of a predetermined reference position with regard to a carriage-movable direction, by delaying the discharging timing from a predetermined reference timing; and for a downstream area located on a downstream side of the predetermined reference position, by advancing the discharging timing from the predetermined reference timing to be earlier.

16 Claims, 12 Drawing Sheets

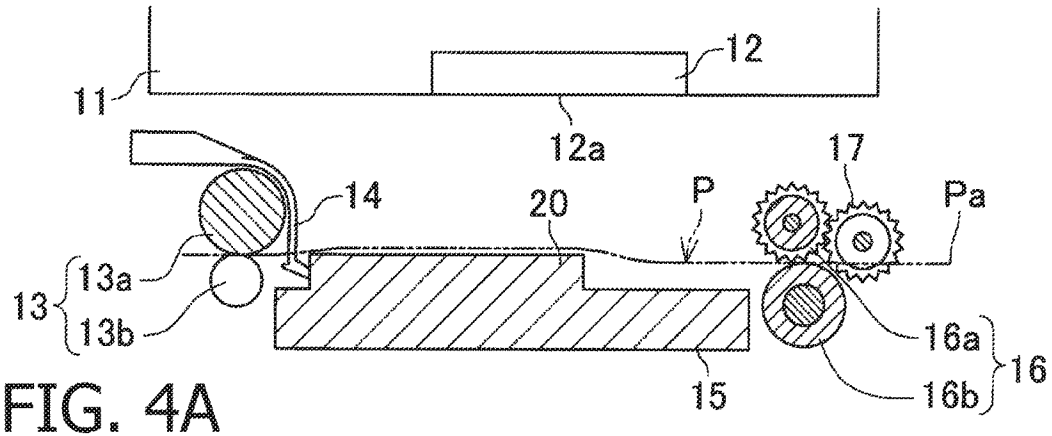
FIG. 4A
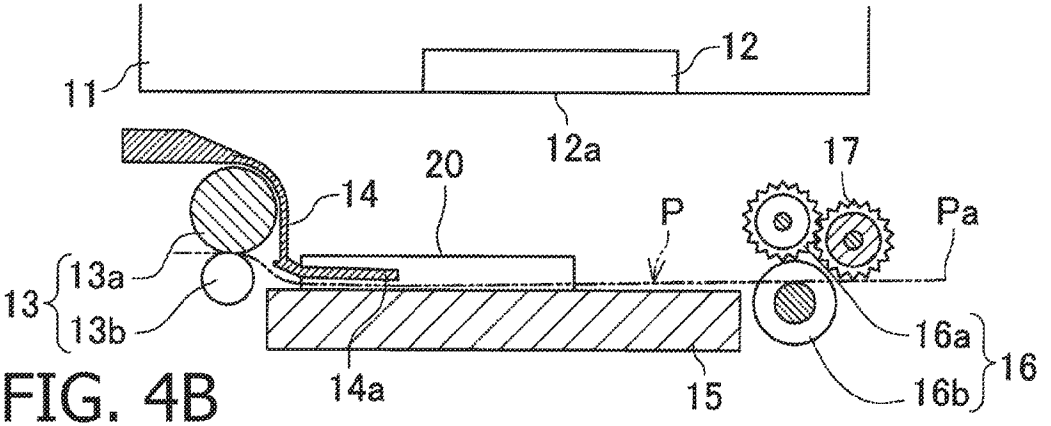
FIG. 4B
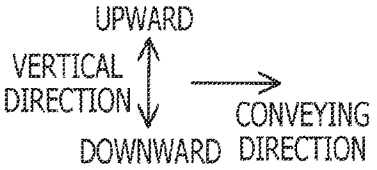

| D[%] | 0≦D<25 | 25≦D<50 | 50≦D<75 | D≧75 |
|---|---|---|---|---|
| A2 | a1 | a2(>a1) | a3(>a2) | a4(>a3) |

FIG. 8A

| D[%] | 0≦D<25 | 25≦D<50 | 50≦D<75 | D≧75 |
|---|---|---|---|---|
| C | c1 | c2(>c1) | c3(>c2) | c4(>c3) |

FIG. 8B

| n | 1 | 2 | 3 | 4 | 5 | 6 | 7 | 8 |
|---|---|---|---|---|---|---|---|---|
| T | t1 | t2(<t1) | t3(<t2) | t4(<t3) | t5(<t4) | t6(<t5) | t7(<t6) | t8(<t7) |
| n | 9 | 10 | 11 | 12 | 13 | 14 | 15 | 16 |
| T | t9 | t10(>t9) | t11(>t10) | t12(>t11) | t13(>t12) | t14(>t13) | t15(>t14) | t16(>t15) |

FIG. 8C

| E[%] | 0≦E<25 | 25≦E<50 | 50≦E<75 | E≧75 |
|---|---|---|---|---|
| U | u1 | u2(>u1) | u3(>u2) | u4(>u3) |

FIG. 8D

LIQUID DISCHARGING DEVICE

CROSS REFERENCE TO RELATED APPLICATION

This application claims priority under 35 U.S.C. § 119 from Japanese Patent Application No. 2015-247200, filed on Dec. 18, 2015, the entire subject matter of which is incorporated herein by reference.

BACKGROUND

Technical Field

The following description relates to one or more aspects of a liquid discharging device capable of discharging liquid through nozzles.

Related Art

A liquid discharging device, e.g., a printer, configured to discharge liquid through nozzles at a recording sheet to print an image, is known. The printer may include a plurality of corrugating plates arranged in line along a scanning direction to face an upper surface of a platen. Meanwhile, a plurality of ribs may be arranged in line in areas on the upper surface of the platen to protrude at intermediate positions between adjoining corrugating plates. Thus, the recording sheet may be pressed downward by the plurality of corrugating plates above and upward by the plurality of ribs below so that the recording sheet may be shaped into a corrugated form that ripples up and down along the scanning direction.

Meanwhile, in order to determine discharging timing to discharge liquid, e.g., ink, at the recording sheet, which is shaped into the corrugated form in the printer, a patch of image may be printed on the recording sheet, and the printed image may be read by a scanner. Based on the read image, deviation amounts of the ink at peaks of convex portions that protrude upward and bottoms of concave portions that recess downward in the recording sheet from intended positions on a hypothetical plane may be achieved and stored in advance in a memory. The stored deviation amounts may be used to determine the discharging timing to discharge the ink at the recording sheet through the nozzles.

SUMMARY

When an image is printed on the recording sheet in the known printer, rigidity of the recording sheet may be lowered due to effects of the ink, and the lowered rigidity may affect a length of the corrugated recording sheet in the scanning direction. For example, the length of the recording sheet in the scanning direction may be shortened. An amount of the change in the length may vary depending on an amount of the ink landed on the recording sheet. Therefore, without considering the change in the length of the recording sheet in the scanning direction, discharging the ink at the recording sheet at the discharging timing, which is calculated with reference to the deviation amounts achieved by reading the printed patch image alone, may still produce displacement in images that are printed consecutively in adjoining areas on the recording sheet. This problem of displacement may occur not only in the recording sheet shaped into the corrugated form but also in a recording sheet that is not shaped into the corrugated form.

An aspect of the present disclosure is advantageous in that a liquid discharging device, capable of discharging liquid at preferable positions on a sheet at preferable discharging timing adjusted in view of the change in the sheet length due to the effect of the liquid applied thereto, is provided.

According to an aspect of the present disclosure, a liquid discharging device, including a liquid discharging head, a carriage, a carriage driver, a sheet conveyer, and a controller, is provided. The liquid discharging head includes a plurality of nozzles and a liquid discharging surface, on which the plurality of nozzles are arranged. On the carriage, the liquid discharging head is mounted. The carriage movement mechanism moves the carriage in a carriage-movable direction, which includes a direction from one side toward the other side and a direction from the other side toward the other side along a predetermined line. The sheet conveyer conveys a sheet in a conveying direction. The conveying direction intersects with the carriage-movable direction. The controller controls the liquid discharging head, the carriage movement mechanism, and the sheet conveyer to execute a printing process, in which a path-printing operation and a conveying operation are repeated alternately for a plurality of times. In the path-printing operation, the controller manipulates the carriage to move in the carriage-movable direction and the liquid discharging head to discharge the liquid through the plurality of nozzles. In the conveying operation, the controller manipulates the sheet conveyer to convey the sheet after completion of the path-printing operation. In the printing process, the controller executes: a discharged amount information obtaining process, in which discharged amount information concerning a discharged amount of the liquid discharged at the sheet in each of the path-printing operations is obtained; a correction parameter calculation process, in which a correction parameter to correct discharging timing to discharge the liquid through the plurality of nozzles is calculated based on the discharged amount information for each of the path-printing operations; and a discharging timing calculation process, in which the discharging timing to discharge the liquid is calculated based on the correction parameter for each of the path-printing operations. In the correction parameter calculation process for a subsequent path-printing operation which is to be conducted later than a first one of the path-printing operations, when the discharged amount of the liquid discharged at the sheet in a latest one of the path-printing operations is greater than a predetermined threshold amount, the controller calculates a value to the correction parameter for the subsequent path-printing operation based on a predetermined reference timing. For an upstream area located on an upstream side of a predetermined reference position with regard to the carriage-movable direction, the controller calculates the value to the correction parameter by delaying the discharging timing from the predetermined reference timing to be later than the discharging timing for the upstream area in a hypothetical subsequent path-printing operation, in which the discharged amount of the liquid discharged at the sheet in the latest one of the path-printing operations is smaller than or equal to the predetermined threshold amount. For a downstream area located on a downstream side of the predetermined reference position with regard to the carriage-movable direction, the controller calculates the value to the correction parameter by advancing the discharging timing from the predetermined reference timing to be earlier than the discharging timing for the downstream area in the hypothetical subsequent path-printing operation, in which the discharged amount of the liquid discharged at the sheet in the latest one of the path-printing operations is smaller than or equal to the predetermined threshold amount.

BRIEF DESCRIPTION OF THE ACCOMPANYING DRAWINGS

FIG. 4A is a cross-sectional view taken along a line IVA-IVA shown in FIG. 2 according to the embodiment of the present disclosure. FIG. 4B is a cross-sectional view taken along a line IVB-IVB shown in FIG. 2 according to the embodiment of the present disclosure.

FIG. 8A is a table defining relation between duty ratios and values for a parameter A2, stored in a memory device in the inkjet printer according to the embodiment of the present disclosure. FIG. 8B is a table defining relation between the duty ratios and values for a basic parameter C, stored in the memory device in the inkjet printer according to the embodiment of the present disclosure. FIG. 8C is a table defining relation between blocks in an ink-dischargeable area and values for a coefficient T, stored in the memory device in the inkjet printer according to the embodiment of the present disclosure. FIG. 8D is a table defining relation between percentages of colored inks and values for a coefficient U, stored in the memory device in the inkjet printer according to the embodiment of the present disclosure.

Figure 9A:
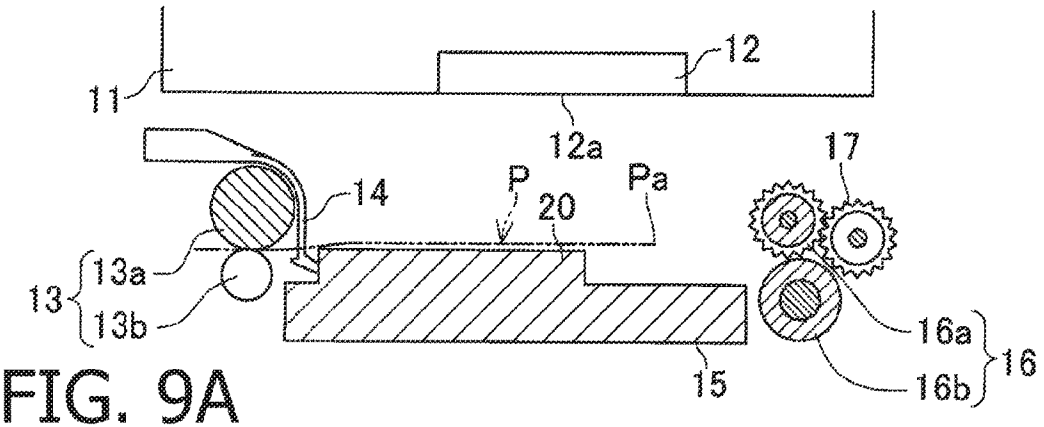
Figure 9B:
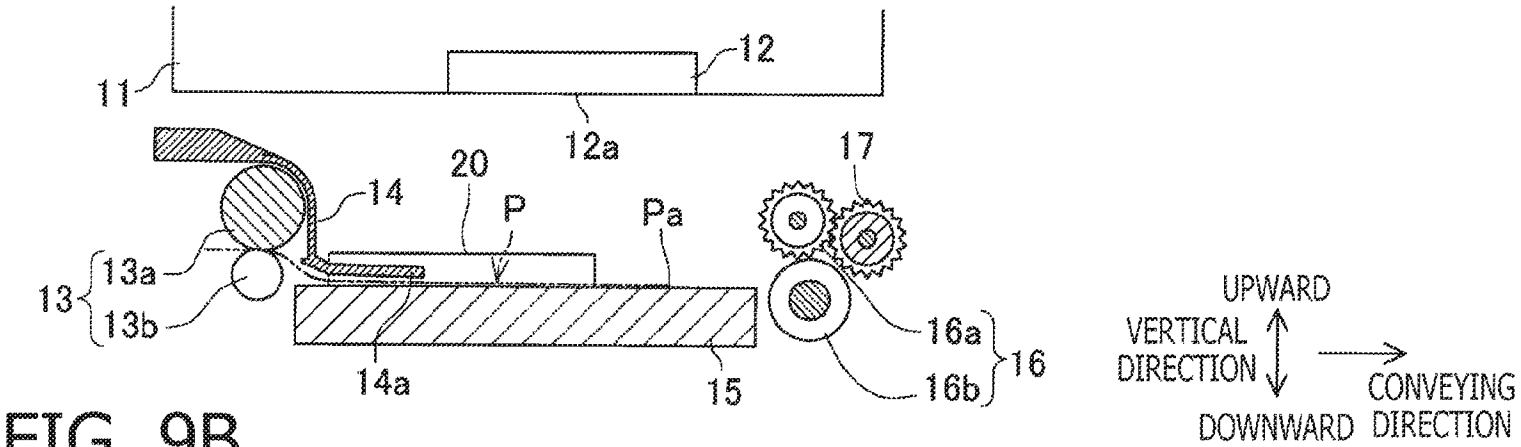

FIG. 9A is a cross-sectional view to illustrate a position of the recording sheet before reaching ejection rollers and corrugating spur wheels, at the area shown in FIG. 4A, in the inkjet printer according to the embodiment of the present disclosure. FIG. 9B is a cross-sectional view to illustrate a position of the recording sheet before reaching the ejection rollers and the corrugating spur wheels, at the area shown in FIG. 4B, in the inkjet printer according to the embodiment of the present disclosure.

Figure 10A:
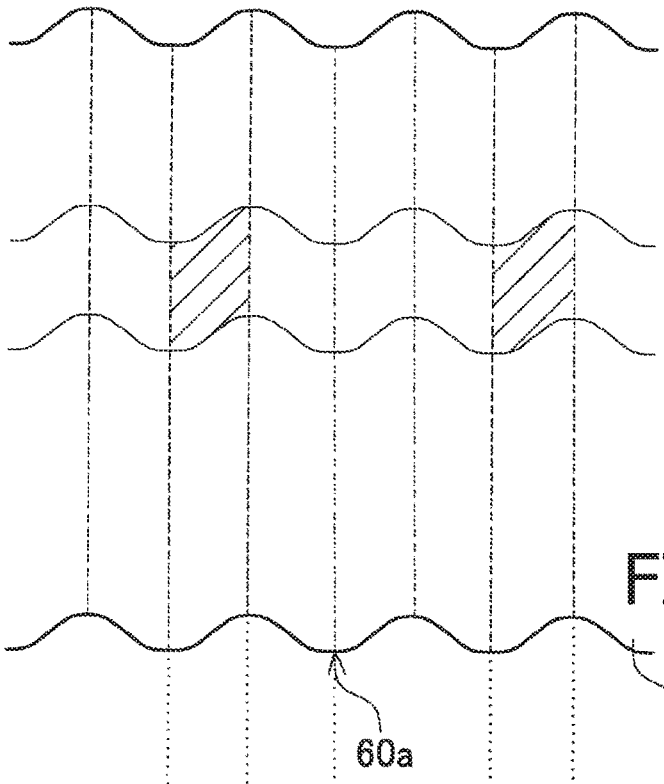
Figure 10B:
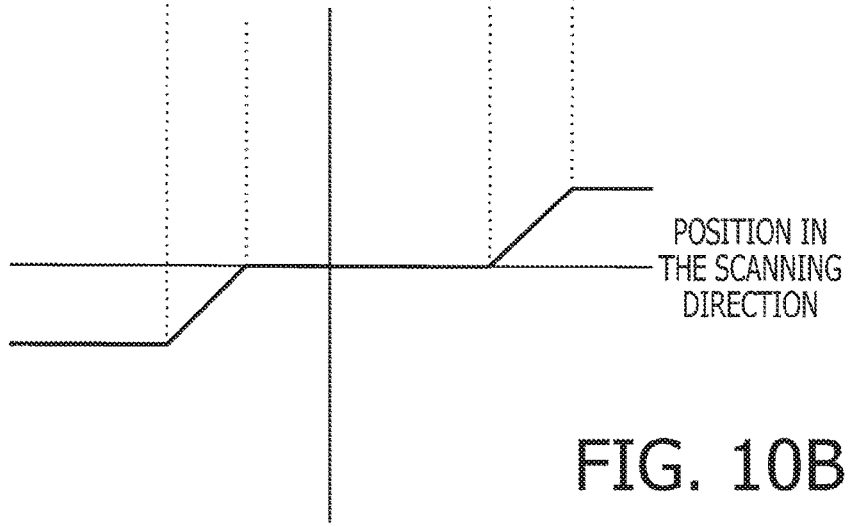

FIG. 10A is an illustrative view of the recording sheet with ink landed on specific areas in a path-printing operation according to the embodiment of the present disclosure. FIG. 10B illustrates a shifting amount of the recording sheet in the scanning direction due to the effect of the ink landed on the specific areas in the path-printing operation according to the embodiment of the present disclosure.

Figure 11B:
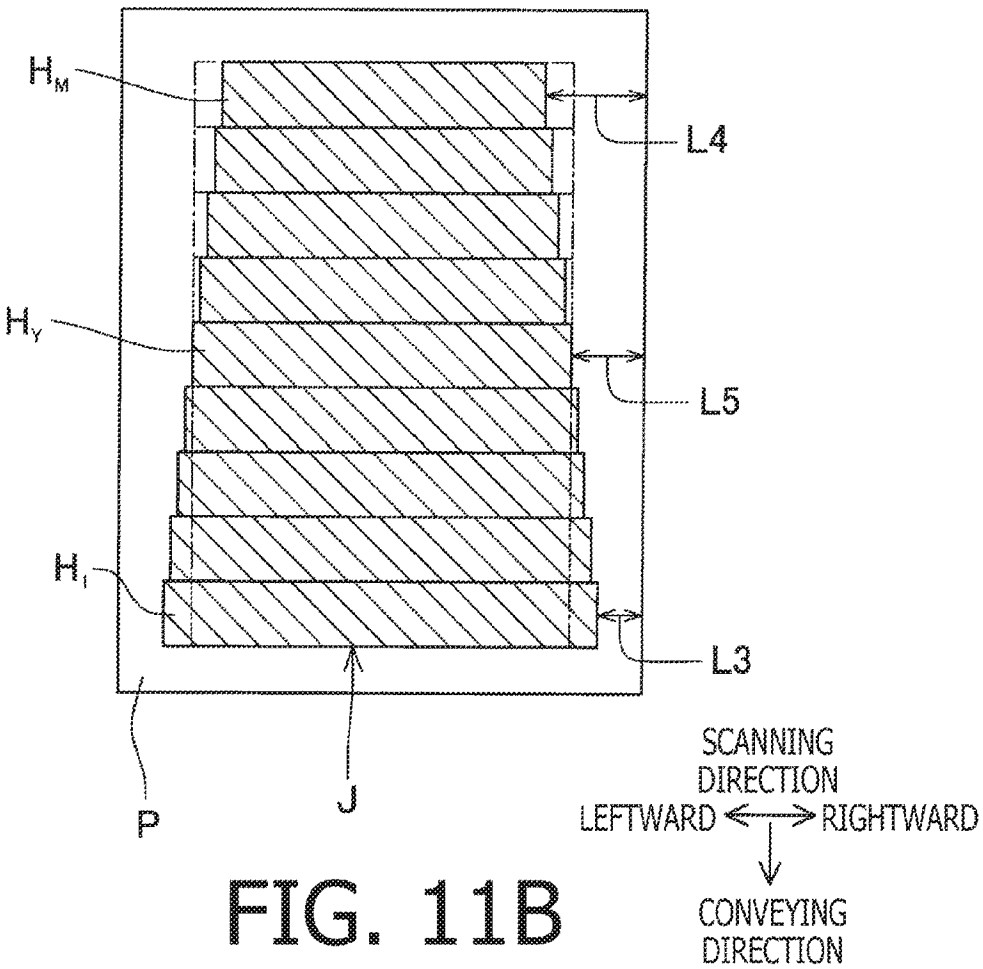
Figure 11A:
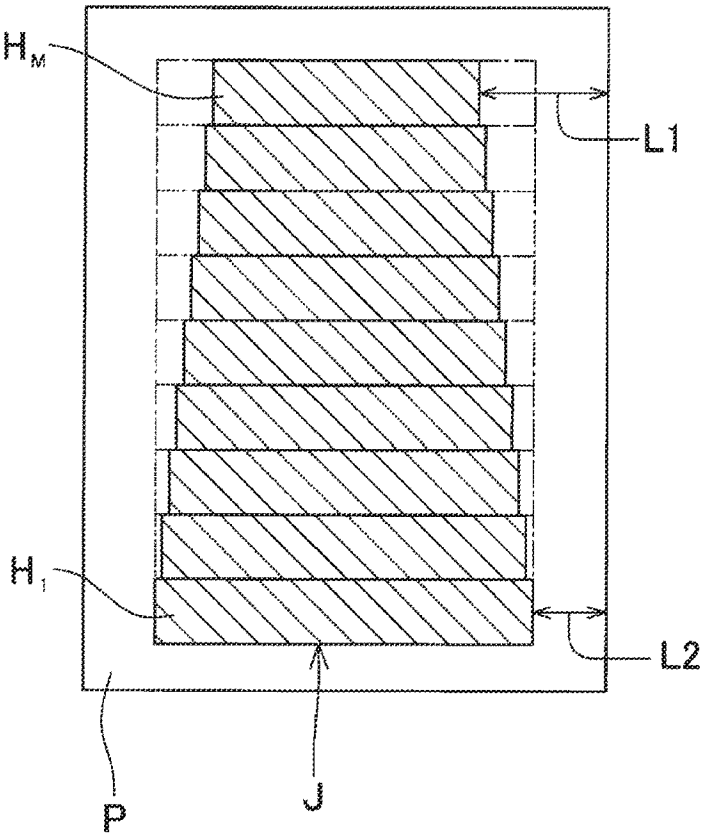

FIG. 11A is an illustrative view of images printed in a plurality of path-printing operations on the recording sheet according to the embodiment of the present disclosure. FIG. 11B is an illustrative view of images printed in a plurality of path-printing operations on the recording sheet according to a first modified example from the embodiment of the present disclosure.

Figure 3A:
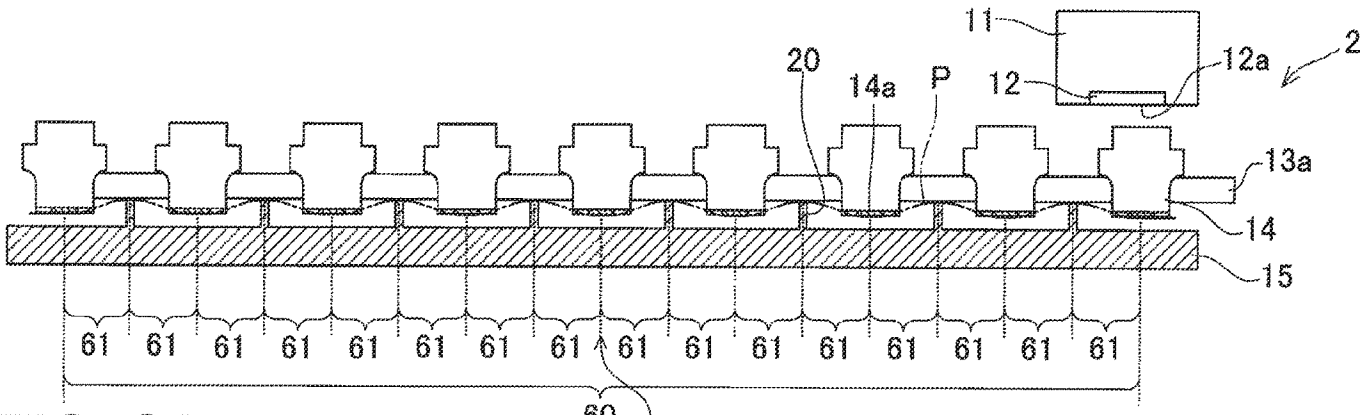
FIG. 3A illustrates a part of the printer unit viewed along an arrow IIIA shown in FIG. 2 according to the embodiment of the present disclosure.
Figure 12A:
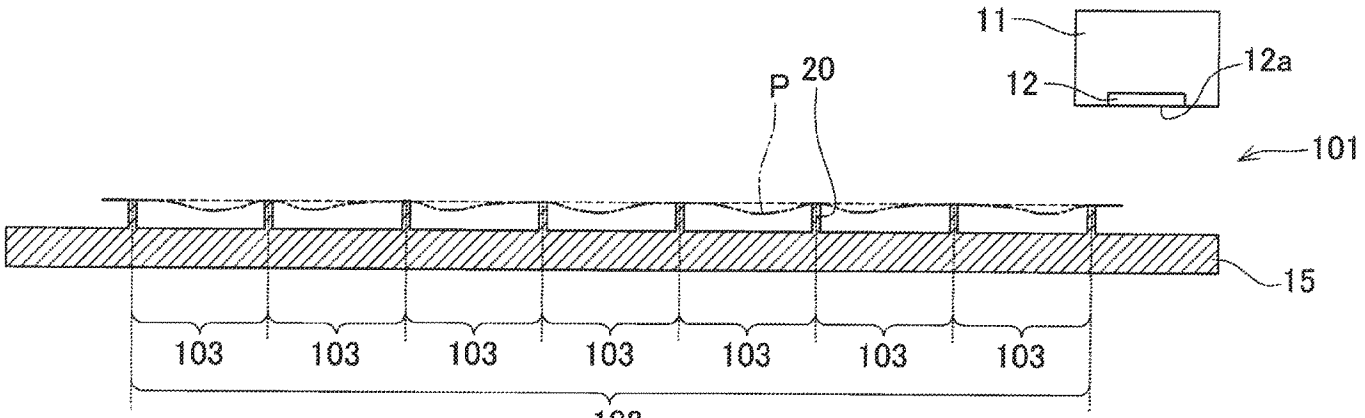
Figure 12B:
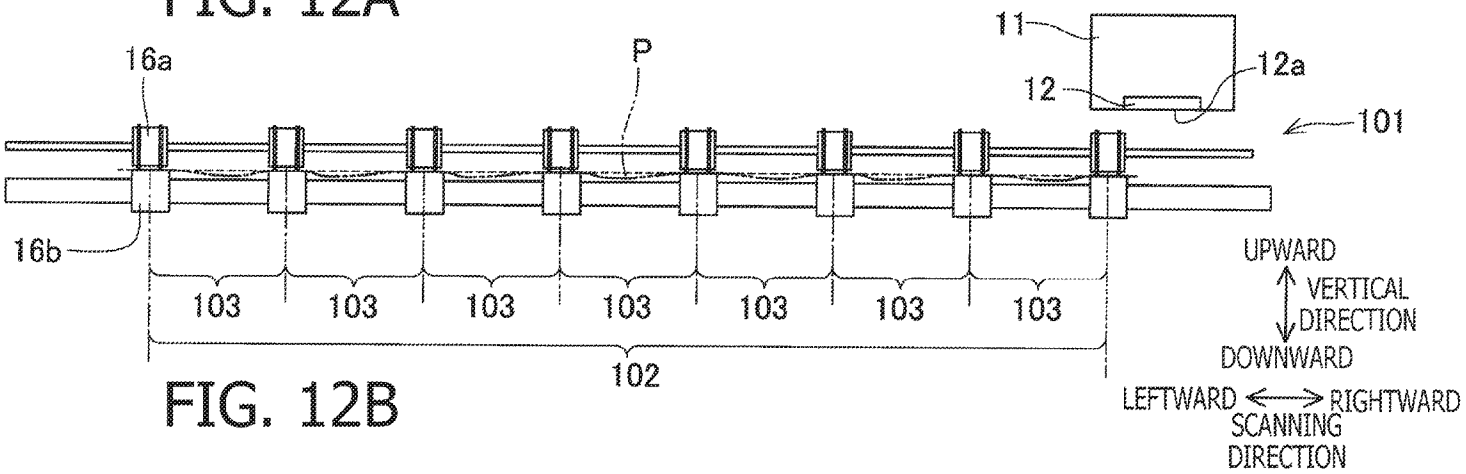

FIG. 12A illustrates the recording sheet placed on ribs on a platen in the printer unit, viewed at a position equivalent to the position shown in FIG. 3A, according to a second modified example from the embodiment of the present disclosure. FIG. 12B illustrates the recording sheet placed on the ribs on the platen in the printer unit, viewed at a position equivalent to the position shown in FIG. 3B, according to the second modified example from the embodiment of the present disclosure.

Figure 13:
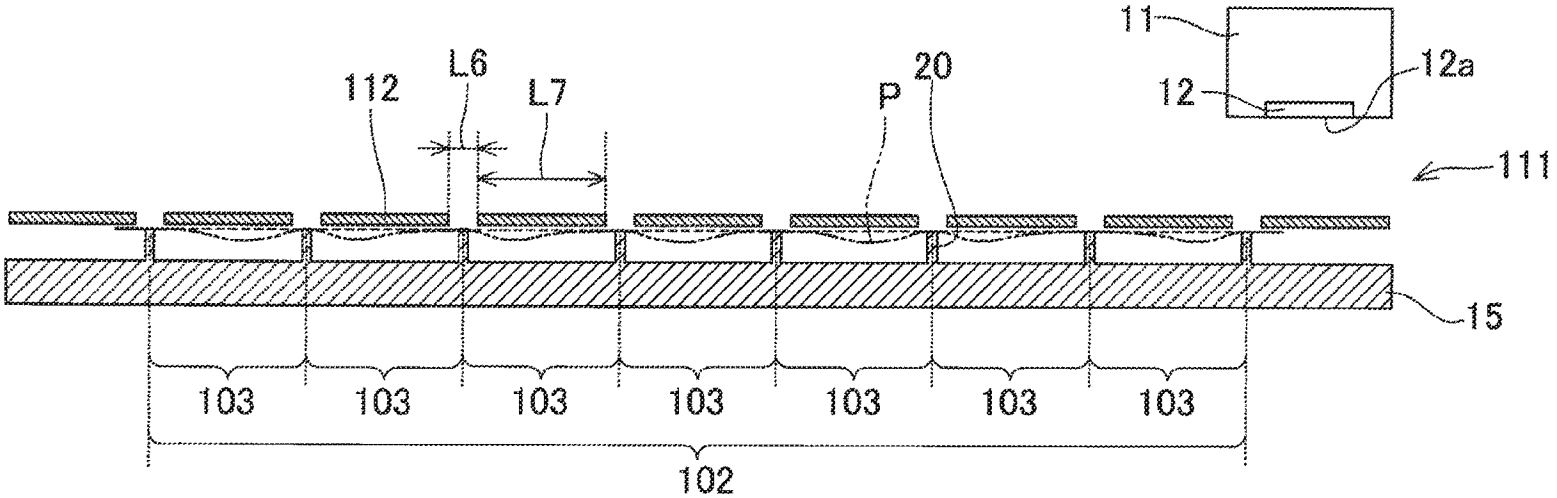

FIG. 13 illustrates the recording sheet placed on ribs on a platen and below presser members in the printer unit, viewed at a position equivalent to the position shown in FIG. 3A, according to a second modified example from the embodiment of the present disclosure.

DETAILED DESCRIPTION

Hereinafter, an embodiment according to an aspect of the present disclosure will be described in detail with reference to the accompanying drawings.

It is noted that various connections may be set forth between elements in the following description. These connections in general and, unless specified otherwise, may be direct or indirect and that this specification is not intended to be limiting in this respect. Aspects of the disclosure may be implemented in computer software as programs storable on computer readable media including but not limited to a random access memory (RAM), a read-only memory (ROM), a flash memory, an electrically erasable ROM (EEPROM), a CD-media, DVD-media, temporary storage, hard disk drives, floppy drives, permanent storage, and the like.

[Overall Configuration of Inkjet Printer]

An inkjet printer 1 of the embodiment may be a multi-function peripheral (MFP) having a plurality of functions such as a printing function to perform printing on a recording sheet P and an image reading function to read an image on a sheet. The inkjet printer 1 includes a printer unit 2 (see FIG. 2), a sheet feeder unit 3, a sheet ejector unit 4, a reader unit 5, an operation unit 6, and a display unit 7. Further, the inkjet printer 1 includes a controller 50 configured to control operations and processes in the inkjet printer 1 (see FIG. 5).

The printer unit 2 is disposed inside the inkjet printer 1. The printer unit 2 is configured to perform printing with the recording sheet P. A detailed configuration of the printer unit 2 will be described later. The sheet feeder unit 3 is configured to feed the recording sheet P to the printer unit 2. The sheet ejector unit 4 is configured to eject the recording sheet P, on which an image is printed by the printer unit 2, outside. The feeder unit 3 includes a plurality of (e.g., two) sheet trays (not shown), in which recording sheets P of different types may be stored. While sheets of paper may contain pulp fiber that aligns along one direction, the recording sheets P may be stored in the sheet trays with the fiber aligning in different directions. That is, in one of the sheet trays, recording sheets P may be arranged to have the fiber aligning along a predetermined scanning direction, and in another one of the sheet trays, recording sheets P may be arranged to have the fiber aligning along a direction orthogonal to the scanning direction. The reader unit 5 may be an image scanner and may be configured to read images formed on original sheets. The operation unit 6 may include buttons. A user may operate the inkjet printer 1 via the buttons in the operation unit 6 to enter information or instructions. The display unit 7 may be a liquid crystal display, which may display information when the inkjet printer 1 is being used.

[Printer Unit]

Figure 2:
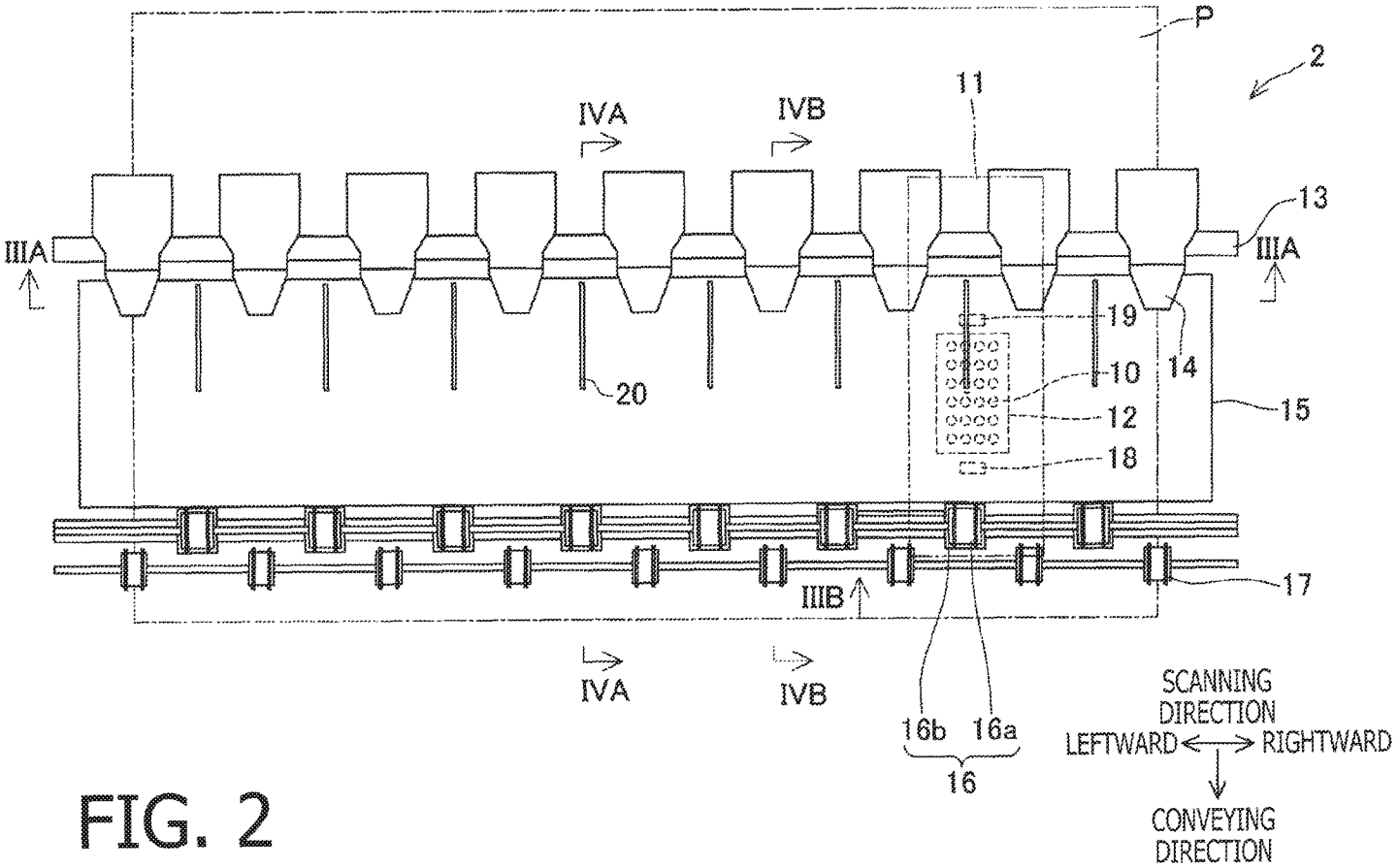
FIG. 2 is a plan view of a printer unit in the inkjet printer according to the embodiment of the present disclosure.

Below will be described the printer unit 2. As shown in FIGS. 2 to 4, the printer unit 2 includes a carriage 11, an inkjet head 12, a conveyer roller 13, a platen 15, a plurality of (e.g., nine) corrugating plates 14, a plurality of (e.g., eight) ejection rollers 16, a plurality of (e.g., nine) corrugating spur wheels 17, an encoder 18, and a medium sensor 19. It is noted that, for the purpose of easy visual understanding in FIG. 2, the carriage 11 in an illustrative position is indicated by a dash-and-two-dots line, and items disposed below the carriage 11 are indicated by solid lines. Further, in FIG. 2, illustration of some of structures that support the carriage 11, e.g., a guiderail, may be omitted.

Figure 1:
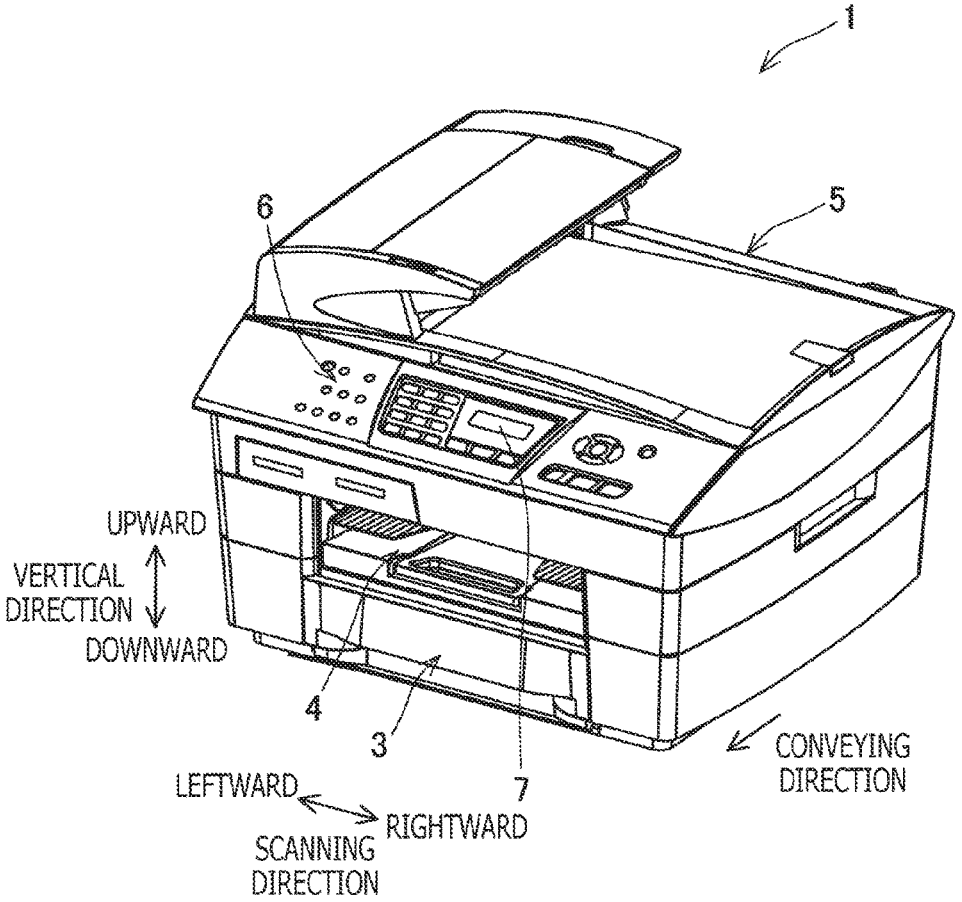
FIG. 1 is a perspective view schematically showing a configuration of an inkjet printer according to an exemplary embodiment of the present invention.

The carriage 11 is configured to reciprocate on the guiderail (not shown) along the scanning direction. In the present embodiment, the scanning direction may include a leftward (right-to-left) direction and a rightward (left-to-right) direction (see FIGS. 1 and 2, for example) and may be referred to as a widthwise direction. The carriage 11 is connected with a carriage motor 56 (see FIG. 5) through a belt (not shown) to be moved to reciprocate in the scanning direction. In other words, the carriage motor 56 and the belt that connects the carriage motor 56 with the carriage 11 may move the carriage 11, and the direction to move the carriage 11 may be the predetermined scanning direction. In the following description, one end on the left and the other end on the right along the scanning direction will be defined as a leftward end and a rightward end, respectively.

The inkjet head 12 is mounted on the carriage 11 to be moved along with the carriage 11. The inkjet head 12 is configured to discharge ink from a plurality of nozzles 10 formed in an ink discharging surface 12*a*, which is a lower surface of the inkjet head 12. The nozzles 10 are formed in line that extends orthogonally to the scanning direction to form a nozzle row 9. Further, in the inkjet head 12, a plurality of, e.g., four, nozzle rows 9 are formed so that inks in four colors, e.g., black, yellow, cyan, and magenta, may be discharged separately from each nozzle row 9. For example, the nozzles 10 in the rightmost nozzle row 9 may discharge black pigmentary ink, and the nozzles 10 in the nozzle rows 9 from the second, third, and fourth to the right may discharge other colored (e.g., yellow, cyan, and magenta) dye inks, respectively.

The conveyer roller 13 is arranged in a position upstream from the inkjet head 12 with regard to a predetermined conveying direction, which may intersect orthogonally with the scanning direction, to convey the recording sheet P. The conveyer roller 13 includes an upper roller 13*a* and a lower roller 13*b*, which are configured to nip therebetween the recording sheet P fed by the sheet feeder unit 3 and convey the recording sheet P in the conveying direction. The upper roller 13*a* may be driven to rotate by a conveyer motor 57 (see FIG. 5), and the lower roller 13*b* may be rotated along with rotation of the upper roller 13*a*.

The nine (9) corrugating plates 14 are disposed to extend from a position coincident with the conveyer roller 13 to a position downstream of the conveyer roller 13 with regard to the conveying direction. The corrugating plates 14 are arranged to be spaced apart evenly from one another at an interval along the scanning direction. Each of the corrugating plates 14 includes a presser 14*a*, which may press the recording sheet P downward, at a downstream end thereof with regard to the conveying direction.

The platen 15 is arranged in a position downstream of the conveyer roller 13 with regard to the conveying direction to face the ink discharging surface 12*a* of the inkjet head 12. The platen 16 is arranged to longitudinally extend in the scanning direction to cover an entire movable range of the carriage 11 that is moved to reciprocate during a printing operation. On an upper surface of the platen 15, formed are a plurality of (e.g., eight) ribs 20, which extend in the conveying direction. The ribs 20 are arranged to be spaced apart evenly from one another at the interval along the scanning direction in positions between adjoining corrugating plates 14.

Upper ends of the ribs 20 are at a position higher than the pressers 14*a*. In other words, the ribs 20 support the recording sheet P from below at positions higher than positions where the pressers 14*a* press the recording sheet P. It may be noted that the above-mentioned quantities of the corrugating plates 14 and the ribs 20, i.e., nine and eight, are merely examples, and the figures may not necessarily be limited to these.

The ejection rollers 16 are arranged in positions downstream of the inkjet head 12 with regard to the conveying direction. The ejection rollers 16 are located in the same positions as the ribs 16 with regard to the scanning direction. Each ejection roller 16 includes an upper roller 16*a* and a lower roller 16*b*, between which the recording sheet P may be nipped from above and below to be conveyed in the conveying direction. The ejection rollers 16 thus convey the recording sheet P in the conveying direction toward the sheet ejector unit 4. The lower rollers 16*b* may be driven to rotate by the conveyer motor 57 (see FIG. 5). The upper rollers 16*a* are spur wheels and may be rotated by the rotation of the lower rollers 16*b*. The upper rollers 16*a* may contact a printed surface of the recording sheet P, which is a surface having an image printed thereon in the printing operation. However, while the upper rollers 16*a* are spurs, of which outer circumferences are not smooth, the ink in the printed image on the recording sheet P may be restrained from being transferred to the upper rollers 16*a*. Thus, the conveyer roller 13 and the ejection rollers 16 may convey the recording sheet P.

The conveyer roller 13 and the ejection rollers 16 may convey the recording sheet P in different fiber alignment. That is, the conveyer roller 13 and the ejection rollers 16 may fed the recording sheet P from one of the sheet trays in such an orientation that the fiber in the recording sheet P substantially aligns with the scanning direction and the recording sheet P fed from the another one of the sheet trays in such an orientation that the fiber in the recording sheet P substantially aligns with the direction orthogonal to the scanning direction.

The corrugating spur wheels 17 are arranged in positions downstream from the ejection rollers 16 with regard to the conveying direction and may press the recording sheet P from above. The corrugating spur wheels 17 are substantially at the same positions as the pressers 14*a* of corrugating plates 14 with regard to the scanning direction. Meanwhile, the corrugating spur wheels 17 are placed at a level lower than the positions where the pressers 14*a* press the recording sheet P. Therefore, the lower rollers 16*b* in the ejection rollers 16 support the recording sheet P from below at a position higher than the corrugating spur wheels 17. In this regard, the corrugating spur wheels 17 are not rollers with smooth outer circumferences but spur wheels. Therefore, the ink on the recording sheet P may be restrained from being transferred to the corrugating spur wheels 17. It may be noted that the quantities of the ejection rollers 16 and the corrugating spur wheels 17, i.e., eight and nine, are merely examples, and the figures may not necessarily be limited to these.

Thus, the recording sheet P may be supported by the eight (8) ribs 20 and the eight (8) lower rollers 16*b* on a lower surface from below and by the nine (9) pressers 14*a* of the corrugating plates 14 and the nine (9) corrugating spur wheels 17 on the upper surface from above to be shaped into the corrugated form, as shown in FIGS. 3 and 4, which ripples up and down along the scanning direction.

The encoder 18 is mounted on the carriage 11 and is configured to output signals indicating positions of the carriage 11, or the inkjet head 12, in the scanning direction to the controller 50. The medium sensor 19 is mounted on the carriage 11 and may output signals indicating presence of the recording sheet P to the controller 50.

[Controller]

Next, explanation concerning the controller 50 for controlling operations and processes in the inkjet printer 1 will be provided below. The controller 50 includes a central processing unit (CPU) 51, a ROM 52, a RAM 53, an EEPROM 54, and an application specific integrated circuit (ASIC) 55.

The controller 50 controls behaviors of the carriage motor 56, the inkjet head 12, the conveyer motor 57, the reader unit 5, the display unit 7, the encoder 18, and the medium sensor 19. Further, the controller 50 may receive various types of signals, including signals corresponding to operations to the operation unit 6, and other signals output from the encoder 18 and the medium sensor 19.

Figure 5:
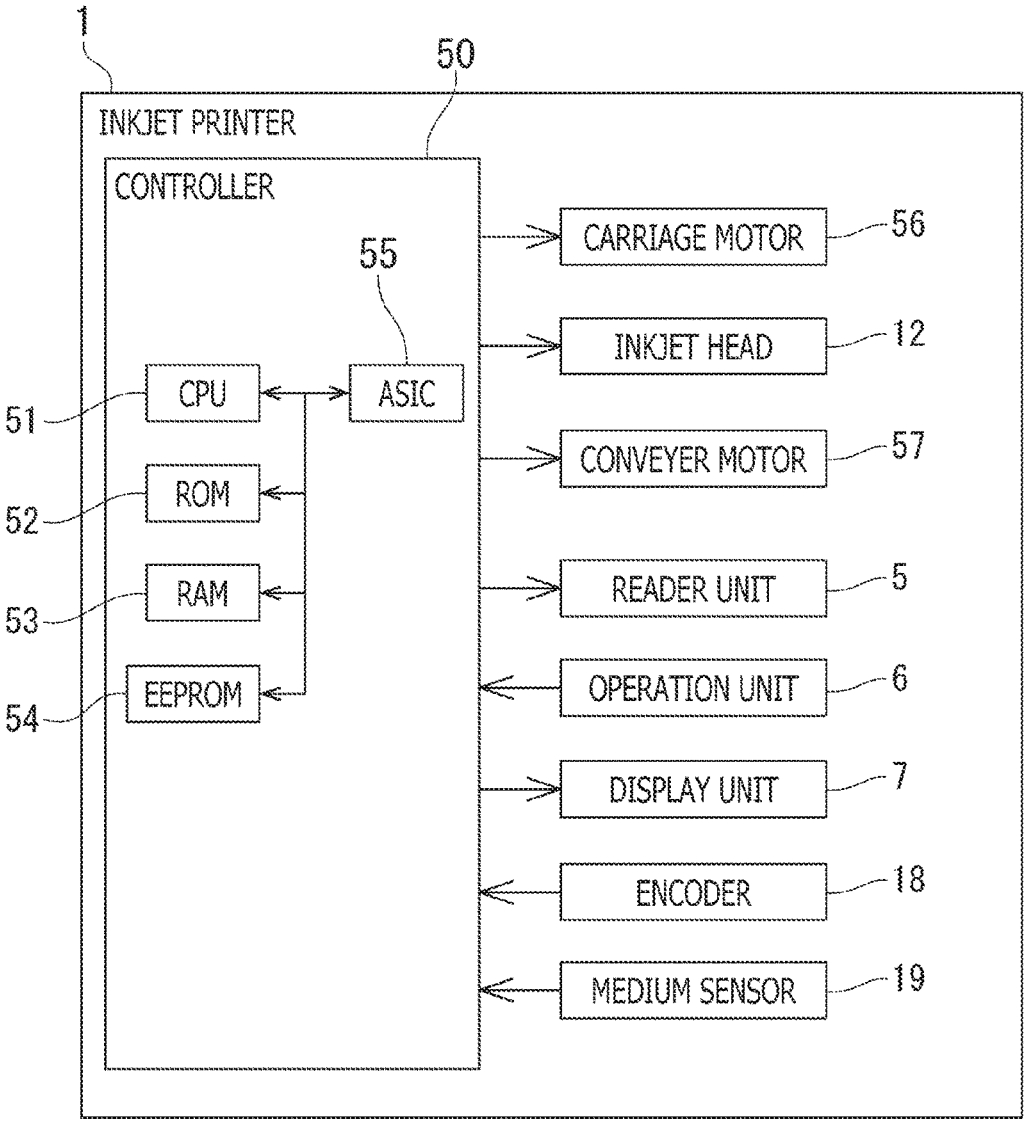
FIG. 5 is a block diagram to illustrate an electrical configuration of the inkjet printer according to the embodiment of the present disclosure.

While FIG. 5 shows solely one (1) CPU 51 to process the signals in the controller 50, the CPU 51 may not necessarily be limited to a single CPU 51 that processes the signals alone but may include a plurality of CPUs 51 that may share the loads of the signal-processing. Further, the ASIC 55 in the controller 50 may not necessarily be limited to a single ASIC that processes the signals alone but may include multiple ASICs 55 that may share the loads of the signal-processing.

[Printing Operation]

Figure 6:
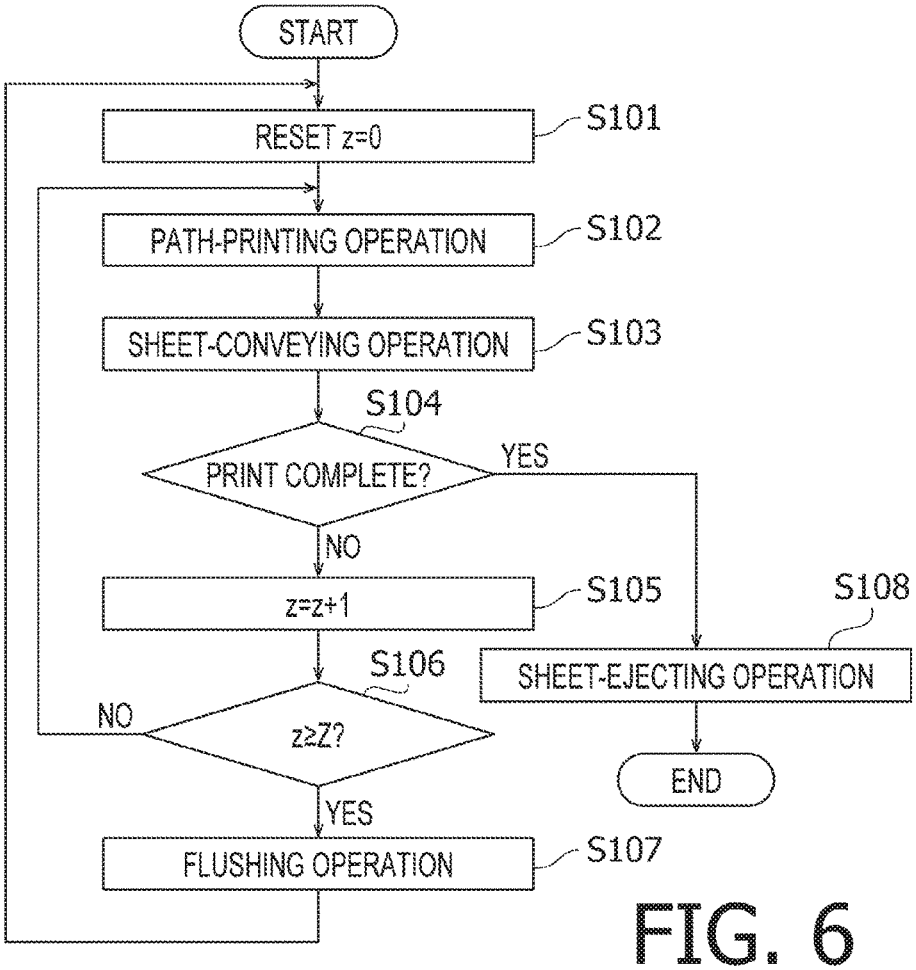
FIG. 6 is a flowchart to illustrate a flow of steps in a printing operation to be conducted by a controller in the inkjet printer according to the embodiment of the present disclosure.

Next, a flow of steps in a printing operation to print an image on the recording sheet P will be described. In the printing operation, the controller 50 may control the printer unit 2 to print an image, consisting of rows of images, on the recording sheet P according to the flow of steps shown in FIG. 6.

When print data is input to the inkjet printer 1 through, for example, an external device such as a personal computer (PC) connected with the inkjet printer 1, in 5101, the controller resets a variable z to zero (0). In S102, the controller conducts a path-printing operation, in which the controller 50 conducts printing a row of image along the scanning direction. The controller 50 may drive the carriage motor 56 to move the carriage 11 along the scanning direction and manipulate the inkjet head 12 to discharge the ink through the nozzles 10 to print the row of image in the path-printing operation. Thereafter, in S103, the controller 50 conducts a sheet-conveying operation, in which the controller 50 drives the conveyer motor 57 to manipulate the conveyer roller 13 and the ejection rollers 16 to convey the recording sheet P for a predetermined length of distance in the conveying direction. The predetermined length of distance may be, for example, equivalent to a dimension of the nozzle rows 9 along the conveying direction.

Next, in S104, if printing of a whole image is not completed (S104: NO), in other words, if there is a remaining row of image to be printed, in S105, the controller 50 increases the variable z by one (1). In S106, when the increased variable z is smaller than a predetermined value Z (S106: NO), the flow returns to S102. Meanwhile, when the increased variable z is greater than or equal to the predetermined value Z (S106: YES), in S107, the controller 50 performs a flushing operation, in which the controller 50 drives the carriage motor 56 to move the carriage 11 to a position, where the ink discharging surface 12*a* faces with a flushable foam (not shown), and manipulates the inkjet head 12 to discharge the ink through the nozzles 10. Thereby, the ink thickened in the nozzles 10 may be discharged outside. Following S106, the flow returns to S101.

Thereafter, when printing of the whole image, i.e., all the rows of images, is completed (S104: YES), in S108, the controller 50 conducts a sheet-ejecting operation, in which the controller 50 drives the conveyer motor 57 to manipulate the conveyer roller 13 and the ejection rollers 16 to eject the recording sheet P at the sheet ejector unit 4.

Thus, in the printer unit 2, the path-printing operation and the sheet-conveying operation are repeated alternately until the whole image is printed. Further, the flushing operation is conducted each time after the rows of images are printed for Z times and before another row of image is printed.

[Discharging Timing in Path-Printing Operation]

Below will be described discharging timing to discharge the ink through the nozzles 10 in the path-printing operation. The discharge timing to discharge the ink through the nozzles 10 in the printer unit 2 may be delayed or advanced from a reference timing being predetermined basic timing for a path-printing operation. In the present embodiment, the term reference timing refers to timing assumed to discharge the ink at a hypothetical recording sheet P, which is not shaped into the corrugated form but is flat, and no ink is applied thereto yet, so that the discharged ink should land on the recording sheet P at predetermined equal intervals along the scanning direction.

Figure 3B:
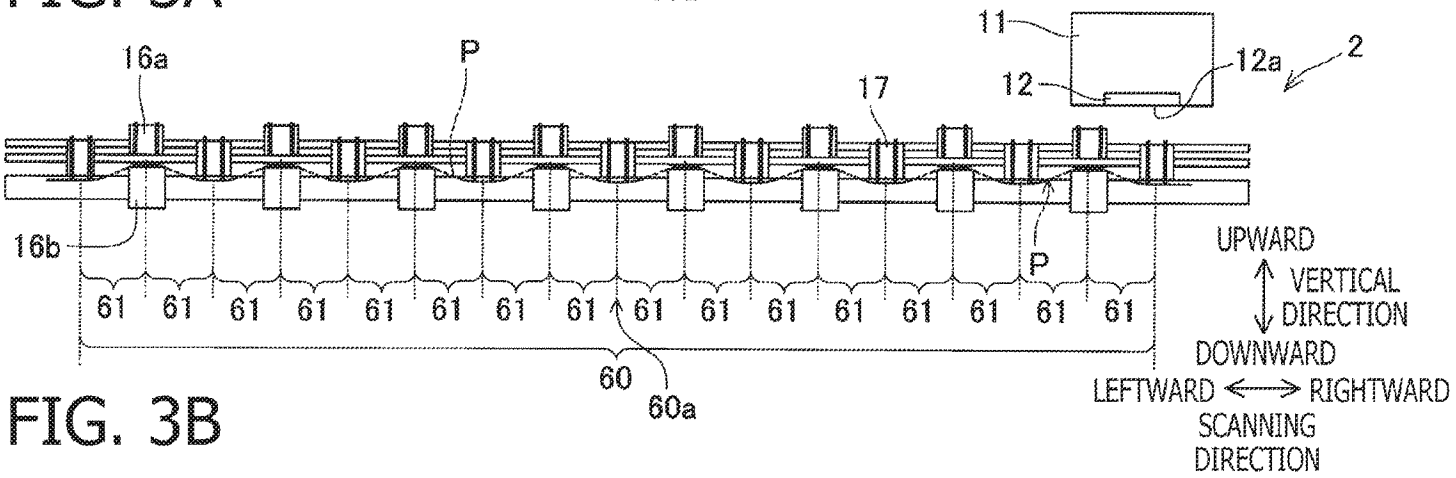
FIG. 3B illustrates a part of the printer unit viewed along an arrow IIIB shown in FIG. 2 according to the embodiment of the present disclosure.

Below will be described the discharging timing in a path-printing operation. With regard to a path-printing operation, as shown in FIGS. 3A-3B, an ink-dischargeable area 60, at which the ink may be discharged through the nozzles 10, is divided into sixteen (16) blocks 61 along the scanning direction. Boundaries of each block 61 along the scanning direction are located at positions of one of the pressers 14*a* and one of the ribs 20 that adjoins the one of the pressers 14*a*. When the printer unit 2 prints an image, the recording sheet P is conveyed in the conveying direction with a widthwise center thereof being fixed at a center 60*a* of the ink-dischargeable area 60 in the scanning direction.

Figure 7:
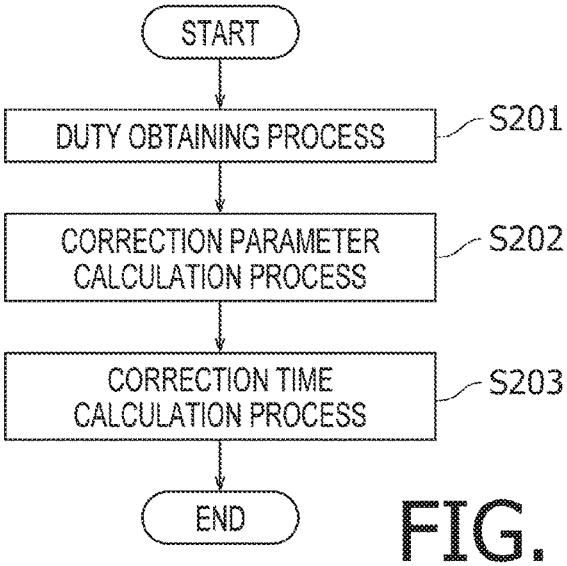
FIG. 7 is a flowchart to illustrate a flow of steps to be conducted by the controller to calculate discharging timing to discharge ink at a recording sheet in a path-printing operation according to the embodiment of the present disclosure.

In order to determine the discharging timing for the path-printing operation, in S201, as shown in FIG. 7, the controller 50 conducts a duty obtaining process. In particular, the controller 50 obtains information concerning duty for each of the blocks 61 contained in the row for the path-printing operation. The duty refers to a rate of an amount of the ink to be discharged at the block 61 with respect to a maximum dischargeable amount of the ink at the block 61. Therefore, a higher number of duty indicates a larger amount of ink to be discharged at the block 61.

Following S201, in S202, the controller 50 conducts a correction parameter calculation process to determine correction parameters $\alpha_{(m,n)}$ and $\beta_{(m,n)}$. The correction parameters $\alpha_{(m,n)}$ and $\beta_{(m,n)}$ represent correction parameters for an n-th block 61 counting from the left (n=1, 2, 3, . . . , 16), in an m-th row (m=1, 2, 3 . . . ), in the m-th path-printing operation. The correction parameters $\alpha_{(m,n)}$ and $\beta_{(m,n)}$ will be described later in detail.

In S203, the controller 50 conducts a correction time calculation process. In particular, a length of correction time $F_{(m,n)}(x)$ to correct the discharging timing, to discharge the ink in the path-printing operation in S102, from the reference timing is derived from the correction parameters $\alpha_{(m,n)}$, $\beta_{(m,n)}$ determined in S202. The value x in the correction time $F_{(m,n)}(x)$ represents a position in the scanning direction: a value x for the center 60*a* is zero (0); a position on an upstream side from the center 60*a* with regard to the moving direction of the carriage 11 in the m-th path-printing operation for m-th row is represented by a positive value; and a position on a downstream side from the center 60*a* with regard to the moving direction of the carriage 11 the m-th path-printing operation for the m-th row is represented by a negative value. The correction time $F_{(m,n)}(x)$ is a function concerning the position x in the scanning direction, and may be represented by a following formula [1] when m is 1 (m=1), i.e., when the row is a first row, and by a following formula [2] when m is 2 or more (m≥2), i.e., when the row is a subsequent (second or onward) row. In this regard, $\gamma_{(m,n)}$ is equal to $\beta_{(m,n)}+\beta_{(m-1,n)}+\ldots+\beta_{(2,n)}+\beta_{(1,n)}$.

$$F_{(1,n)}(x)=\alpha_{(1,n)}\times G_{(n)}(x)+\beta_{(1,n)}\times x+\sigma_{(1,n)} \quad \text{[Formula 1]}$$

$$F_{(m,n)}(x)=\alpha_{(m,n)}\times G_{(n)}(x)+\gamma_{(m,n)}\times x+\sigma_{(m,n)} \quad \text{[Formula 2]}$$

When the correction time $F_{(m,n)}(x)$ indicates a positive value, the discharging timing to discharge the ink through the nozzles 10 at the block 61 is delayed for a length $|F_{(m,n)}(x)|$ from the reference timing. When the correction time $F_{(m,n)}(x)$ indicates a negative value, the discharging timing to discharge the ink through the nozzles 10 at the block 61 is advanced for a length $|F_{(m,n)}(x)|$ from the reference timing. Therefore, determining the correction time $F_{(m,n)}(x)$ may be substantially equivalent to determining the discharging timing for the path-printing operation. In this regard, it may be noted that the correction time $F_{(m,n)}(x)$ represents a length of correction time for the n-th block 61 from the left in the m-th printing operation in the m-th row.

The function $G_{(n)}(x)$ is a function, e.g., a cubic function, provided to absorb the change in the gap between the ink discharging surface 12*a* and the recording sheet P along the scanning direction that may be caused by shaping the recording sheet P into the corrugated form. The function $G_{(n)}(x)$ is provided to each block 61. Each function $G_{(n)}(x)$ may be achieved by, for example, printing a predetermined pattern of image on the recording sheet P by the printer unit 2, reading the printed pattern of image by the reader unit 5, and calculation based on a result of the reading.

When the printer unit 2 prints an image on the recording sheet P, amplitude in the corrugated recording sheet P, i.e., height of the recording sheet P at each position along the scanning direction, may vary among the rows of path-printing operations and among the blocks 61 due to several factors such as a position of the recording sheet P in the conveying direction and influence of the ink landed on the recording sheet P. In this regard, the correction parameter $\alpha_{(m,n)}$ is provided in consideration of the amplitude in the corrugated form of the recording sheet P, which may vary depending on the position of the row indicated by the value m and the position of the block 61 counting from the left indicated by the value n. Therefore, the term $\alpha_{(m,n)}\times G_{(n)}(x)$ is provided in the correction time $F_{(m,n)}(x)$ for each block 61 to correct landing positions for the ink so that the ink should land on the recording sheet P at positions in the block 61 closer to the intended positions in consideration of the change in the gap between the ink discharging surface 12*a* and the recording sheet P in the scanning direction that is caused by the corrugated form of the recording sheet P.

Further, additionally to the change in height at each position in the recording sheet P, each position in the recording sheet P may move in the scanning direction due to several causes such as being shaped into the corrugated form and lowered rigidity by influence of the ink landed on the corrugated recording sheet P. The influence of the ink may include, for example, wetness and weight of the ink on the recording sheet P. In other words, the recording sheet P may contract, or expand, in the scanning direction by these factors. In this regard, while a block 61 in the recording sheet P may move in the scanning direction by the influence of the link landing on the recording sheet P in the corrugated form, the block 61 may further move in the scanning direction by another block(s) 61 that is closer to the center 60*a* moving toward the center 60*a* due to the influence of the ink landed on the another block(s) 61. Therefore, an amount for a block 61 in the recording sheet P to move in the scanning direction may be larger or smaller depending on a position of the block 61 in the scanning direction with respect to the center 60*a*. In other words, the farther the block 61 is located from the center 60*a* along the scanning direction, for the larger amount the block 61 may move, at an increasing rate being proportional to a value in x. Further, the moving amount for the block 61 in the scanning direction may vary depending on an amount of the ink landing on the block 61 in the path-printing operation. Therefore, the term $\gamma_{(m,n)}\times x$ in the correction time $F_{(m,n)}(x)$ is provided to adjust the ink landing positions in view of the contractive movement of the recording sheet P in the scanning direction.

The correction parameter σ is provided to correct the landing positions for the ink on the recording sheet P in view of possible displacement of landing positions of the ink on the recording sheet P, which may be caused due to a factor other than the change in the amplitude in the corrugated form of the recording sheet or the contractive movement of the recording sheet P in the scanning direction. For example, the correction parameter σ may be provided in view of an overall height and/or a position of the recording sheet P in the scanning direction, which may vary depending on a position of the recording sheet P in the conveying direction. In the meantime, however, the correction parameter σ may not necessarily be related to the present embodiment directly. Therefore, detailed explanation of the correction parameter σ will be herein omitted.

[Method to Determine the Correction Parameters]

Below will be described a method to determine the corrected parameters $\alpha_{(m,n)}$ and $\beta_{(m,n)}$ in S202. According to the present embodiment, the information concerning the duty for each path-printing operation to print an image on the recording sheet P may be obtained prior to starting a first row of the path-printing operations in S201. Thereafter, in S202, the correction parameters $\alpha_{(m,n)}$ and $\beta_{(m,n)}$ for every path-printing operation may be calculated, and in S203, the correction time $F_{(m,n)}(x)$ for each path-printing operation may be calculated in S203. However, obtainment of the information concerning the duty for each path-printing operation, calculation of the correction parameters $\alpha_{(m,n)}$ and $\beta_{(m,n)}$, and calculation of the correction time $F_{(m,n)}(x)$ may be conducted in turn one-by-one for each row of path printing operation until all of the path-printing operations to print the whole image are completed.

<Correction Parameters for the First Row>

The correction parameters $\alpha_{(1,n)}$ and $\beta_{(1,n)}$ for the first row of path-printing operation among a plurality of path-printing operations, i.e., when m is 1 (m=1), are predetermined constant values, which are positive values. Therefore, the term $\beta_{(1,n)}\times x$ in the correction time $F_{(1,n)}(x)$ should indicate a positive value, as long as the blocks 61 are on the upstream side from the center 60*a* with regard to the moving direction of the carriage 11 (x>0), and should indicate a negative value, as long as the blocks 61 are on the downstream side from the center 60*a* with regard to the moving direction of the carriage 11 (X<0), in the first path-printing operation. In this regard, values for the correction parameter $\beta_{(1,n)}$ for the blocks 61 on the outer side with regard to the scanning direction are larger. That is, the farther the block 61 is from the center 60*a*, the larger value the correction parameter $\beta_{(1,n)}$ for the block 61 takes. In other words, the correction parameters $\beta_{(1,n)}$ for the blocks 61 are expressed in inequalities: $\beta_{(1,1)}>\beta_{(1,2)}> \ldots \beta_{(1,8)}$ and $\beta_{(1,9)}<\beta_{(1,10)}<\beta_{(1,11)} \ldots <\beta_{(1,16)}$.

<Correction Parameters for the Subsequent Rows>

The correction parameters $\alpha_{(m,n)}$ and $\beta_{(m,n)}$ for the subsequent rows, i.e., when m is greater than or equal to 2 (m≥2), may be determined in the following calculation. That is, the correction parameters $\alpha_{(m,n)}$ and $\beta_{(m,n)}$ for the subsequent rows are derived from the following formula [3], in which two parameters $A1_{(m,n)}$ and $A2_{(m-1,n)}$ are combined:

$$\alpha_{(m,n)}=A1_{(m,n)}+A2_{(m-1,n)} \quad \text{[Formula 3]}$$

In this regard, during the path-printing operations for the subsequent rows, as well as the path-printing operation for the first row, each height and position in the scanning direction on the recording sheet P may change due to the factors including the corrugated form of the recording sheet P. In this regard, the parameter $A1_{(m,n)}$ is provided to correct the landing positions of the ink on the recording sheet P in view of the change in height in the n-th block 61 from the left in the m-th row, which may change due to the corrugated form of the recording sheet P. The parameter $A1_{(m,n)}$ is, as well as the correction parameter $\alpha_{(1,n)}$, constant regardless of the duty in the path-printing operations and invariable.

Meanwhile, by the time when the path-printing operation for the subsequent row starts, each height and position in the scanning direction on the recording sheet P may have been affected by lowered rigidity, which may have been lowered by the influence of the ink landed on the recording sheet P in the earlier path-printing operation for the previous row. In particular, the rigidity may be affected mostly by the ink landed on the recording sheet P in a latest one of the earlier path-printing operations conducted for the adjoining preceding row. Therefore, the parameter $A2_{(m-1,n)}$ is provided to correct the landing positions of the ink in the n-th block 61 from the left on the recording sheet P in view of the latest height for the n-th block 61 from the left, which may have been influenced by the lowered rigidity of the recording sheet P lowered by the ink landed on the recording sheet P in the latest path-printing operation for the previous, i.e., the [m−1]th, row.

In this regard, a table that defines relation between ranges of the duty D and values for the parameter A2 is stored in the ROM 52 in the controller 50 (see FIG. 8A). In the present embodiment, with reference to this table, the parameter A2 takes a value associated with a duty range, which includes the duty D of the ink landed in the n-th block 61 from the left in the [m−1]th row, for the parameter $A2_{(m-1,n)}$.

Under a condition where rigidity of the recording sheet P is lowered by the influence of the landed ink, the height of the recording sheet P may tend to be influenced more largely when an amount of the landed ink is larger. Therefore, in the present embodiment, for a higher duty D, the parameter A2 takes a larger value. In other words, the higher the duty value D is, the larger value the parameter A2 takes. For example, as shown in FIG. 8A, for duty D being higher than or equal to 0% and lower than 25%, the parameter A2 takes a value a1; for a duty value D being higher than or equal to 25% and lower than 50%, the parameter A2 takes a value a2; for a duty value D being higher than or equal to 50% and lower than 75%, the parameter A2 takes a value a3; and for a duty value being higher than or equal to 75%, the parameter A2 takes a value a4. In this regard, a magnitude relation of the values a1-a4 is represented in inequalities: a1<a2<a3<a4.

The correction parameter $\beta_{(m,n)}$ to be used when the row is a subsequent row, i.e., when m is greater than or equal to 2 (m≥2), is represented in Formula 4 described below, in which two parameters $B1_{(m,n)}$ and B2(m−1,n) are combined.

$$\beta_{(m,n)}=B1_{(m,n)}+B2_{(m-1,n)} \quad \text{[Formula 4]}$$

The parameter $B1_{(m,n)}$ is provided to correct the landing positions of the ink in view of the positions moved in the scanning direction due to the corrugated form of the recording sheet P. The parameter $B1_{(m,n)}$ does not depend on the duty D, as well as the correction parameter $\beta_{(1,n)}$ for the first row. The parameter $B1_{(m,n)}$ is a positive value. The parameter $B1_{(m,n)}$ takes a larger value for a block 61 closer to an outer end with regard to the scanning direction. In other words, similarly to the correction parameter $\beta_{(1,n)}$, the closer the block 61 is to the outward end with regard to the scanning direction, the larger value the parameter $B1_{(m,n)}$ takes.

The parameter $B2_{(m-1,n)}$ is provided to correct the landing positions of the ink in view of the positions moved in the scanning direction due to the rigidity change lowered by the ink discharged in the latest path-printing operation for the [m−1]th row.

The parameter $B2_{(m-1,n)}$ is represented in Formula 5 described below, in which a basic parameter $C_{(m-1,n)}$ is multiplied by five (5) coefficients: $T_{(m,n)}$, $U_{(m-1,n)}$, $V_{(m-1)}$, W, and $Q_{(m-1)}$.

$$B2_{(m-1,n)}=T_{(n)}\times U_{(m-1,n)}\times V_{(m-1)}\times W\times Q\times C_{(m-1,n)} \quad \text{[Formula 5]}$$

Below are described the basic parameter $C_{(m-1,n)}$ and the coefficients $T_{(n)}$, $U_{(m-1,n)}$, W, and $Q_{(m-1)}$.

The basic parameter $C_{(m-1,n)}$ is set depending on the duty D in the n-th block 61 from the left in the latest path-printing operation for the [m−1]th row. In the ROM 52 in the controller 50, stored is a table that defines relation between the duty ranges and values for the basic parameter C (see FIG. 8B). In the present embodiment, the basic parameter $C_{(m-1,n)}$ takes a value defined in the table for a basic parameter C in association with the duty D for the n-th block 61 from the left in the latest path-printing operation for the [m−1]th row. In this regard, the higher the duty D is, the larger value the basic parameter C takes. For example, as shown in FIG. 8B, for duty D being higher than or equal to 0% and lower than 25%, the basic parameter C takes a value c1; for a duty value D being higher than or equal to 25% and lower than 50%, the basic parameter C takes a value c2; for a duty value D being higher than or equal to 50% and lower than 75%, the basic parameter C takes a value c3; and for a duty value being higher than or equal to 75%, the basic parameter C takes a value c4. In this regard, a magnitude relation of the values c1-c4 is represented in inequalities: c1<c2<c3<c4. The values c1-c4 are positive numbers. With this condition, the higher the duty D for the n-th block 61 from the left in the [m−1]th row is, the larger value the correction parameter $\beta_{(m,n)}$ takes.

A value for the coefficient $T_{(n)}$ depends on an order (i.e., a value in n) of the block 61 counting from the left. In the ROM 52 in the controller 50, stored is a table that defines relation between the order of the block 61 counting from the left (i.e., the value in n) and values for the coefficient T (see FIG. 8C). In the present embodiment, with reference to this table, the coefficient T takes a value associated with the n-th block 61 from the left for the coefficient $T_{(n)}$. In the present embodiment, the coefficient T takes a larger value for a block 61 closer to the outer end with regard to the scanning direction. In other words, the closer the block 61 is to the outward end with regard to the scanning direction, the larger value the coefficient T takes. For example, a magnitude relation of values t1 through t16 assigned to the first through sixteenth blocks 61 from the left respectively is represented in inequalities: t1>t2> . . . >t7>t8; and t9<t10< . . . <t15<t16. The values in t1 through t16 are positive numbers. With this condition, the correction parameter $\beta_{(m,n)}$ takes a larger value for the block 61 on the outer side closer to the outward end with regard to the moving direction of the carriage 11 in the m-th row during the path-printing operation.

In the present embodiment, when the carriage 11 moves rightward in the path-printing operation for the m-th row, between two blocks 61 that are on a leftward side of the center 61*a* (i.e., between two blocks 61 among the first through eighth blocks 61 from the left), one that is in a leftward position farther from the center 61*a* may be recognized as an upstream block 61 with regard to the moving direction, and the other that is in a rightward position closer to the center 60*a* may be regarded as a downstream block 61 with regard to the moving direction. Meanwhile, between two blocks 61 that are on a rightward side of the center 61*a* (i.e., between two blocks 61 among the ninth through sixteenth blocks 61 from the left), one that is in a leftward position closer to the center 61*a* may be recognized as an upstream block 61 with regard to the moving direction, and the other that is in a rightward position farther from the center 60*a* may be regarded as a downstream block 61 with regard to the moving direction.

Similarly, when the carriage 11 moves leftward in the path-printing operation for the m-th row, between two blocks 61 that are on the rightward side of the center 61*a* (i.e., between two blocks 61 among the ninth through sixteenth blocks 61 from the left), one that is in a rightward position farther from the center 61*a* may be recognized as an upstream block 61 with regard to the moving direction, and the other that is in a leftward position closer to the center 60*a* may be regarded as a downstream block 61 with regard to the moving direction. Meanwhile, between two blocks 61 that are on the leftward side of the center 61*a* (i.e., between two blocks 61 among the first through eighth blocks 61 from the left), one that is in a rightward position closer to the center 61*a* may be recognized as an upstream block 61 with regard to the moving direction, and the other that is in a leftward position farther from the center 60*a* may be regarded as a downstream block 61 with regard to the moving direction.

A value for the coefficient $U_{(m-1,n)}$ depends on a colored-ink ratio E, which is a ratio of an amount of discharged colored inks with respect to a total amount of inks discharged at the n-th block 61 from the left in the [m−1]th row. In the ROM 52 in the controller 50, stored is a table that defines relation between the colored-ink ratio E and the coefficient U (see FIG. 8D). In the present embodiment, with reference to this table, the coefficient U takes a value associated with the n-th block 61 from the left in the [m−1]th row as the coefficient $U_{(m-1,n)}$. In the present embodiment, the coefficient U takes a larger value for a higher value in the colored-ink ratio E. In other words, the higher the colored-ink ratio E is, the larger value the coefficient U takes. For example, as shown in FIG. 8D, for a colored-ink ratio E being higher than or equal to 0% and lower than 25%, the coefficient U takes a value u1; for a colored-ink ratio E being higher than or equal to 25% and lower than 50%, the coefficient U takes a value u2; for a colored-ink ratio E being higher than or equal to 50% and lower than 75%, the coefficient U takes a value u3; and for a colored-ink ratio E being higher than or equal to 75%, the coefficient U takes a value u4. In this regard, a magnitude relation of the values u1-u4 is represented in inequalities: u1<u2<u3<u4. With this condition, the higher the colored-ink ratio E in the n-th block 61 from the left in the [m−1]th row indicates, the larger value the correction parameter $\beta_{(m,n)}$ takes.

A value for the coefficient $V_{(m-1)}$ depends on a position of the recording sheet P with regard to the conveying direction. Specifically, the value for the coefficient $V_{(m-1)}$ depends on a condition whether a leading end of the recording sheet P has reached the ejection rollers 16 and the corrugating spur wheels 17. That is, when a leading end Pa of the recording sheet P has not reached the position between the ejection rollers 16 and the corrugating spur wheels 17 (see FIGS. 9A-9B) during the path-printing operation for the [m−1]th row, the coefficient V takes a value v1 for the coefficient $V_{(m-1)}$. On the other hand, when the leading end Pa of the recording sheet P has reached the position between the ejection rollers 16 and the corrugating spur wheels 17 (see FIGS. 4A-4B) during the path-printing operation for the [m−1]th row, the coefficient V takes a value v2 for the coefficient $V_{(m-1)}$. In this regard, in which row of the path printing operation the leading end Pa of the recording sheet P should reach the position of the ejection rollers 16 and the corrugating spur wheels 17 may be determined in advance. For example, the leading end Pa of the recording sheet P may reach the position of the ejection rollers 16 and the corrugating spur wheels 17 at a k-th row. When k is larger than [m−1], i.e., (m−1)<k, the coefficient V takes the value v1 for the coefficient $V_{(m-1)}$ and, when k is smaller than or equal to [m−1], i.e., (m−1)≥k, the coefficient V takes the value v2 for the coefficient $V_{(m-1)}$. In this regard, the value v2 is larger than the value v1 (v2>v1). The values v1, v2 are positive values and stored in the ROM 52. With this condition, during the path-printing operation for the [m−1]th row, the correction parameter $\beta_{(m,n)}$ takes a larger value when the leading end Pa of the recording sheet P reaches the position of the ejection rollers 16 and the corrugating spur wheels 17 and afterward than when the leading end Pa of the recording sheet P has not yet reached the position of the ejection rollers 16 and the corrugating spur wheels 17.

A value for the coefficient W depends on a type of the recording sheet P. In the present embodiment, the coefficient W takes a value w1 when the recording sheet P is in the arrangement to have the fiber therein aligned in parallel with the scanning direction. On the other hand, the coefficient W takes a value w2 when the recording sheet P is in the arrangement to have the fiber therein aligned orthogonally to the scanning direction. The aligning direction of the fiber in the recording sheet P may depend on a type of the recording sheet P. Therefore, the value for the coefficient W being either w1 or w2 may be determined based on the information concerning the type of the recording sheet P, which may be input in the controller 50 together with the print data. The value w2 is larger than the value w1. The values w1, w2 are positive values and stored in the ROM 52. With this condition, the correction parameter $\beta_{(m,n)}$ takes a larger value when the fiber in the recording sheet P aligns orthogonally to the scanning direction than when the fiber in the recording sheet P aligns in parallel with the scanning direction.

A value for the coefficient $Q_{(m-1)}$ depends on a length of a time period between completion of the previous path-printing operation for the [m−1]th row and start of the path-printing operation for the m-th row. In this regard, the flushing operation may be conducted between completion of the previous path-printing operation for the [m−1]th row and start of the upcoming path-printing operation for the m-th row. Therefore, when no flushing operation is conducted between the two path-printing operations for two consecutive rows, the coefficient Q takes a value q1 for the coefficient $Q_{(m-1)}$; and when the flushing operation is conducted between the two path-printing operations, the coefficient Q takes a value q2 for the coefficient $Q_{(m-1)}$. The value q2 is larger than the value q1 (q2>q1). The values q1, q2 are positive values and stored in the ROM 52. With this condition, the correction parameter $\beta_{(m,n)}$ takes a larger value when a flushing operation is conducted between the path-printing operations for the [m−1]th row and the m-th row than when no flushing operation is conducted between the path-printing operations for the [m−1]th row and the m-th row.

In the present embodiment described above, when the discharged ink lands on the recording sheet P, rigidity of the recording sheet P may be lowered, and height of every position in the recording sheet P may shift. Accordingly, the length of the recording sheet P in the scanning direction may be changed, and every position on the recording sheet P in the scanning direction may shift. Specifically, in the present embodiment, the recording sheet P is shaped into the corrugated form rippling up and down along the scanning direction by being pressed by the nine (9) pressers 14*a* from above and by being supported by the eight (8) ribs 20 from below. In this regard, the recording sheet P may tend to contract, or expand, along the scanning direction due to lowered rigidity at areas that do not contact the pressers 14*a* or the ribs 20.

Therefore, the present embodiment provides the correction parameter $\beta_{(m,n)}$, which includes the parameter $B2_{(m-1,n)}$ to correct the ink landing positions in the n-th block 61 from the left in the m-th row on the recording sheet P in view of the influence of the ink landed on the n-th block 61 from the left in the latest path-printing operation in the [m−1]th row (m≥2). Based on this correction parameter $\beta_{(m,n)}$, the correction time $F_{(m,n)}(x)$ for discharging the ink at the n-th block 61 from the left for the path printing-operation directed to the m-th row is determined. Thereby, the ink may be discharged to land on positions more preferably adjusted in consideration of the shift of each position on the recording sheet P in the scanning direction.

In this regard, the height of the recording sheet P in each position may shift more largely when an amount of the ink landed on the recording sheet P is larger, and each position on the recording sheet P may move along the scanning direction for a larger amount. In the meantime, the amount of the ink discharged through the nozzles 10 to print an image may not be constant throughout the path-printing operation but may vary depending on the positions in the scanning direction on the recording sheet P. For example, the ink may be discharged at limited areas, such as shaded areas in FIG. 10A, along the scanning direction in a row in a path-printing operation. With the ink landing on the limited areas, a moving amount for a position where the ink landed on the recording sheet P to move in the scanning direction may vary while a moving amount for a position on the recording sheet P where no ink landed to move in the scanning direction may stay constant (see FIG. 10B). It may be noted in FIG. 10B that a right-hand side and a left-hand side along a horizontal axis with respect to the center 60*a* correspond to a right-hand side and a left-hand side along the scanning direction on the recording sheet P respectively, while an amount of variation of a position in the recording sheet P moving leftward along the scanning direction is indicated in a positive value, and an amount of variation of a position in the recording sheet P moving rightward along the scanning direction is indicated in a negative value.

In the present embodiment, a row, or the ink-dischargeable area 60, at which the ink may be discharged through the nozzles 10 along the scanning direction in a path-printing operation, is divided into a plurality of blocks 61 along the scanning direction. To each of the blocks 61 in an m-th row in the path-printing operation, applied is the correction parameter $\beta_{(m,n)}$. Thereby, the ink may be discharged at more preferable timing adjusted in accordance with the variation of each position in the recording sheet P, which may have been affected by the ink landed on the earlier path-printing operations, to land on each preferable position on the recording sheet P.

Meanwhile, in the present embodiment, the recording sheet P is pressed downward from above by the pressers 14*a* and the corrugating spur wheels 17 and upward from below by the ribs 20 and the lower rollers 16*b* to be shaped into the corrugated form rippling up and down along the scanning direction. Therefore, when rigidity of the recording sheet P as a whole is lowered, the positions in the recording sheet P may shift mainly due to the decrease of rigidity at intermediate positions between the pressers 14*a* and the ribs 20 that adjoin each other along the scanning direction, and between the corrugating spur wheels 17 and the lower rollers 16*b* that adjoin each other along the scanning direction. Therefore, in the present embodiment, the timing to discharge the ink is adjusted on basis of a block 61, of which widthwise ends along the scanning direction are set at a position of a presser 14*a* and a corrugating spur wheel 17 and at a position of a rib 20 adjoining the presser 14*a* and a lower roller 16*b* adjoining the corrugating spur wheel 17. Thus, the ink may be discharged at more preferable timing adjusted in accordance with the shift of each position in the recording sheet P, which may have been affected by the ink landed on the earlier path-printing operation, to land on each preferable position on the recording sheet P.

Further, in the present embodiment, a value for the parameter $B2_{(m-1,n)}$ to calculate the correction parameter $\beta_{(m,n)}$ is defined as described above in Formula 3.

As described above, when rigidity of the recording sheet P is lowered by the influence of the ink landed earlier on the recording sheet P, height of each position in the recording sheet P may shift for a larger amount when an amount of the ink landed on the recording sheet P is larger, and accordingly, each position in the recording sheet P may move in the scanning direction for a larger amount. Therefore, in the present embodiment, the higher the duty in the n-th block 61 from the left in the latest [m−1]th row is, the larger value the basic parameter $C_{(m-1,n)}$ takes, and the larger value the correction parameter $\beta_{(m,n)}$ takes. Thus, the ink may be discharged at more preferable timing adjusted in accordance with the shift of each position in the recording sheet P, which may have been affected by the ink landed on the earlier path-printing operation, to land on each preferable position on the recording sheet P.

Further, when the recording sheet P is shaped into the corrugated form rippling up and down along the scanning direction by the pressers 14*a*, the ejection rollers 16, the ribs 20, and the corrugating spur wheels 17, binding force from the pressers 14*a*, the ejection rollers 16, the ribs 20, and the corrugating spur wheels 17 to hold the recording sheet P may be smaller at widthwise outer areas of the recording sheet P in the scanning direction than at a central area of the recording sheet P. Accordingly, positions in the widthwise outer areas on the recording sheet P may shift in the scanning direction for larger amounts than positions in the central area on the recording sheet P due to the influence of the ink landed on the recording sheet P. Therefore, in the present embodiment, for the block 61 closer to the widthwise end along the scanning direction, the coefficient $T_{(n)}$ takes a larger value so that the correction parameter $\beta_{(m,n)}$ should take a larger value. Thus, the ink may be discharged at more preferable timing adjusted in accordance with the shift of each position in the recording sheet P, which may have been affected by the ink landing on the earlier path-printing operation, to land on each preferable position on the recording sheet P.

Furthermore, the colored inks being dye inks may infiltrate the recording sheet P more easily than the black ink being the pigmentary ink. Therefore, under a condition where, for example, a total amount of the inks landing on one block 61 and a total amount of the inks landing on another block 61 are equal, each position in one of the blocks 61 with a higher colored-ink ratio E may move in the scanning direction for a larger amount. In other words, the higher the colored-ink ratio E is, for the larger amount the position in the recording sheet P moves in the scanning direction. Accordingly, in the present embodiment, when the colored-ink ratio E in the n-th block 61 from the left in latest path-printing operation for the [m−1]th row is higher, the coefficient $U_{(m,n)}$ takes a larger value so that the correction parameter $\beta_{(m,n)}$ should take a larger value. Thus, the ink may be discharged at more preferable timing adjusted in accordance with the shift of each position in the recording sheet P, which may have been affected by the ink landing on the earlier path-printing operation, to land on each preferable position on the recording sheet P.

In the present embodiment, when the leading end of the recording sheet P reaches the position of the ejection rollers 16 and the corrugating spur wheels 17, the recording sheet P may be shaped into the corrugated form both by the pressers 14*a* and the ribs 20, which are arranged on the upstream side of the inkjet head 12 with regard to the conveying direction, and by the ejection rollers 16 and the corrugating spur wheels 17, which are arranged on the downstream side of the inkjet head 12 with regard to the conveying direction. In contrast, before the leading end of the recording sheet P reaches the position of the ejection rollers 16 and the corrugating spur wheels 17, the recording sheet P may be shaped into the corrugated form by the ejection rollers 16 and the corrugating spur wheels 17 alone, which are arranged on the upstream side with regard to the conveying direction. Therefore, under the condition where the leading end of the recording sheet P has reached the position of the ejection rollers 16 and the corrugating spur wheels 17, the corrugated form in the recording sheet P may ripple for a larger amount vertically than the condition where the leading end of the recording sheet P has not yet reached the position of the ejection rollers 16 and the corrugating spur wheels 17. Further, each position in the recording sheet P may be moved more largely in the scanning direction by the ink landed on the recording sheet P when ripples in the corrugating form of the recording sheet P are larger than when the ripples in the corrugating form of the recording sheet P are smaller. Therefore, in the present embodiment, the coefficient $V_{(m-1)}$ takes a larger value once the leading end of the recording sheet P reached the position of the ejection rollers 16 and the corrugating spur wheels 17 ([m−1]≥k) than when the leading end of the recording sheet P has not yet reached the position of the ejection rollers 16 and the corrugating spur wheels 17 ([m−1]<k) so that the correction parameter $\beta_{(m,n)}$ should take a larger value. Thus, the ink may be discharged at more preferable timing adjusted in accordance with the shift of each position in the recording sheet P, which may have been affected by the ink landing on the earlier path-printing operation, to land on each preferable position on the recording sheet P.

Further, when the ink lands on the recording sheet P, the recording sheet P may tend to deform in a direction orthogonal to an aligning direction of the fiber more easily than in a direction parallel with the aligning direction. Therefore, when the ink lands on the recording sheet P arranged to have the fiber aligning orthogonally to the scanning direction, each position in the recording sheet P may move in the scanning direction for a larger amount than the position in the recording sheet P arranged to have the fiber aligning in parallel with the scanning direction. In this regard, in the present embodiment, the coefficient W takes a larger value when the fiber in the recording sheet P aligns orthogonally to the scanning direction than when the fiber in the recording sheet P aligns in parallel with the scanning direction. Thus, the ink may be discharged at more preferable timing adjusted in accordance with the shift of each position in the recording sheet P, which may have been affected by the ink landing on the earlier path-printing operation, to land on each preferable position on the recording sheet P.

Further, when rigidity of the recording sheet P is lowered by the influence of the ink landed on the recording sheet P, the ink may tend to infiltrate the recording sheet P more deeply if a longer period of time elapsed since the landing of the ink on the recording sheet P, and the rigidity of the recording sheet P may be lowered even more by the deeply infiltrated ink. In other words, the longer period of time elapses since the landing of the ink on the recording sheet P, the larger amount each position in the recording sheet P may move in the scanning direction. In this regard, after a path-printing operation for the [m−1]th row, a flushing operation may or may not be conducted before another path-printing operation for the m-th row starts. When the flushing operation is conducted, a time period in between the two path-printing operations, more specifically, between completion of the path-printing operation for the [m−1]th row and start of the path-printing operation for the m-th row, may be longer than a time period between the two path-printing operations without the flushing operation. In the present embodiment, therefore, when the flushing operation is conducted after the path-printing operation for the [m−1] th row and before the path-printing operation for the m-th row, the coefficient $Q_{(m-1)}$ takes a larger value than a value for the coefficient $Q_{(m-1)}$ when no flushing operation is conducted. Thus, the ink may be discharged at more preferable timing adjusted in accordance with the shift of each position in the recording sheet P, which may have been affected by the ink landing on the earlier path-printing operation, to land on each preferable position on the recording sheet P.

In the present embodiment, as described above, the discharging timing to discharge the ink at the m-th row (m≥2) in the path-printing operation are adjusted in view of the shift of each position in the recording sheet P along the scanning direction due to the influence of the ink having been discharged in the latest path-printing operation for the [m−1]th row. In this regard, for example, unlike the present embodiment, the correction time $F_{(m,n)}(x)$ for the m-th row in the path-printing operation may be achieved by Formula 6 described below, which lacks the consideration for the earlier correction parameters $\beta_{(m-1,n)}, \beta_{(m-2,n)}, \ldots, \beta_{(2,n)}, \beta_{(1,n)}$. In such a case, however, images printed in consecutive rows that adjoin each other in the conveying direction may be displaced from each other in the scanning direction.

$$F_{(m,n)}(X)=\alpha_{(m,n)}\times G_{(n)}(X)+\beta_{(m,n)}\times X+\sigma_{(m,n)} \quad \text{[Formula 6]}$$

In contrast, in the present embodiment, when the row for the upcoming path-printing operation is the subsequent row (m≥2), the correction time $F_{(m,n)}(x)$ for the m-th row is achieved by Formula 2 described above, in which a cumulative sum $\gamma_{(m)}$, containing the retrospective sum of the correction parameters $\beta_{(m-1,n)}, \beta_{(m-2,n)}, \ldots, \beta_{(2,n)}, \beta_{(1,n)}$ in the preceding path-printing operations for the first through [m−1]th rows, is used as the correction parameter $\beta_{(m,n)}$. Thereby, displacement of the images printed in the rows that are consecutive along the conveying direction due to the correction of the discharging timing may be prevented. In other words, between two images printed in two rows that adjoin each other in the conveying direction, an image printed in a latter row may be prevented from being displaced from the former row, in the scanning direction.

In the meantime, when the correction time $F_{(m,n)}(x)$ is calculated, the correction parameter $\beta_{(1,n)}$ for the first row (m=1) is determined irrespective of the duty of the ink discharged in any path-printing operation. In other words, for the path-printing operation for the first row, in order to calculate the correction parameter $\beta_{(1,n)}$, no cumulative sum $\gamma_{(m)}$ is considered. Meanwhile, the other correction parameters $\beta_{(m-1,n)}, \beta_{(m-2,n)}, \ldots, \beta_{(2,n)}$ for the subsequent rows are calculated in view of the duty caused in the earlier path-printing operations. Therefore, the correction parameters that are calculated in view of the duty caused in the earlier path-printing operations may include the correction parameters $\beta_{(m-1,n)}, \beta_{(m-2,n)}, \ldots, \beta_{(2,n)}$ but does not include the correction parameter $\beta_{(1,n)}$. Therefore, according to the present embodiment, it may be explained that, when the row for the path-printing operation is the third or subsequent row (m≥3), the correction time $F_{(m,n)}(x)$ is achieved in view of an cumulative sum $\gamma'_{(m)}$, which contains $\beta_{(m-1,n)}, \beta_{(m-2,n)}, \ldots, \beta_{(2,n)}$ but excludes the correction parameter $\beta_{(1,n)}$.

Although an example of carrying out the invention has been described, those skilled in the art will appreciate that there are numerous variations and permutations of the liquid discharging device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described modified examples of the present embodiment.

In the previous embodiment described above, the cumulative sum $\gamma_{(m)}$, which contains the sum of all the correction parameters $\beta_{(m-1,n)}, \beta_{(m-2,n)}, \ldots, \beta_{(2,n)}, \beta_{(1,n)}$ in the earlier path-printing operations for the first through [m−1]th rows, is used to obtain the correction time $F_{(m,n)}(x)$ for the m-th row (m≥2) in the upcoming path-printing operation. However, methods to obtain the correction time $F_{(m,n)}(x)$ using the cumulative sum $\gamma_{(m)}$ may not necessarily be limited to the one described above.

For example, in a first modified example, an image may be printed on an area at a center with regard to the conveying direction on the recording sheet P in a Y-th row among multiple rows of path-printing operations. More specifically, when an image is to be printed on the recording sheet P in M times of path-printing operations for M rows (M being the multiple number), if M is an even number, Y is equal to M divided by 2 (Y=M/2); but if M is an odd number, Y is either (M plus 1) divided by 2, i.e., (M+1)/2, or M minus 1 divided by 2, i.e., (M-1)/2. Under this condition, the correction time $F_{(1,n)}(x)$ for the path-printing operation for the first row may be obtained from Formula 7 described below. Further, the correction time $_{(m,n)}(x)$ for the path-printing operation for the m-th path (m≥2) may be obtained from Formula 8 described below. According to these formulae, the correction time $F_{(m,n)}(x)$ for the path-printing operation in the m-th path (m≥2) may be obtained by subtracting a cumulative value $\gamma_{(Y)}$, which is a cumulative value for the Y-th row, from the cumulative sum $\gamma_{(m)}$ for the m-th row.

$$F_{(1,n)}(X)=\alpha_{(1,n)}\times G_{(n)}(X)+[\beta_{(1,n)}-\gamma_{(Y,n)}]\times X+\sigma_{(1,n)} \quad \text{[Formula 7]}$$

$$F_{(m,n)}(X)=\alpha_{(m,n)}\times G_{(n)}(X)+[\gamma_{(m,n)}-\gamma_{(Y,n)}]\times X+\sigma_{(m,n)} \quad \text{[Formula 8]}$$

In this regard, it may be recognized that in the previous embodiment the correction time $F_{(m,n)}(x)$ is calculated in consideration of the cumulative sum $\gamma_{(m)}$ so that the images printed in two consecutive rows of path-printing operations may be prevented from being displaced from each other in the scanning direction. Otherwise, as has been described, with the ink landed on the recording sheet P, each position in the recording sheet P might tend to move inward toward the center with regard to the scanning direction. Therefore, if the correction time $F_{(m,n)}(x)$ is calculated by the method according to Formula 6 described above, images in the subsequent rows may more likely be displaced inward toward the center with regard to the scanning direction, as shown in shaded images in FIG. 11A, than the images in positions of the images in the subsequent rows printed in accordance with the correction time $F_{(m,n)}(x)$ derived from Formula 2 described above, as shown in dash-and-dot lines in FIG. 11A. Further, positions of images that are printed later may tend to move inward toward the center for larger amounts. In other words, according to the correction time $F_{(m,n)}(x)$ derived from Formula 6, the inward displacement may accumulate in the later rows.

As a result of the accumulated displacement, an image printed in a last row may be displaced inward toward the center with regard to the scanning direction for a largest amount among the images printed in preceding rows. Meanwhile, the image in the first row may be printed in accordance with the correction time $F_{(m,n)}(x)$, which is not affected by the cumulative sum y(m); therefore, the image in the first row may not be displaced from the calculated position. Accordingly, within a lateral margin between a widthwise end of the recording sheet P and an image J, a length L1, which is a length between the widthwise end of the recording sheet P and a liner image HM in the last row, may be largest with regard to the scanning direction. Meanwhile, a length L2, which is a length between the widthwise end of the recording sheet P and a linear partial image H1 in the first row, may be smallest. Thus, a difference between the length L2 and the length L1 [L1−L2] may be visually recognizable, and the displacement of the linear partial images H1-HM from one another toward the center in the scanning direction may be distinctive.

In this regard, according to the first modified example, the correction time $F_{(m,n)}(x)$ may be calculated in consideration of the cumulative sum $\gamma_{(m)}$, which does not include a cumulative value $\gamma_{(Y)}$ for the Yth-row at the center with regard to the conveying direction. In other words, the cumulative value $\gamma_{(Y)}$ for the Y-th row is subtracted from the cumulative sum $\gamma_{(m)}$. According to this calculation, an amount of displacement in the scanning direction for the linear partial image HY in the Y-th row with respect to a position derived from Formula 6 described above, e.g., a position indicated by dash-and-dot lines in FIG. 11B, may be smallest within the image J as a whole. In particular, as shown in FIG. 11B, the linear partial images printed earlier than the linear partial image HY may be displaced outward in the scanning direction from the positions derived from Formula 6. In this regard, the earlier the linear partial images are printed, the larger amount the linear partial images may be displaced outward. Meanwhile, the linear partial images printed later than the linear partial image HY may be displaced inward in the scanning direction from the positions derived from Formula 6. In this regard, the earlier the linear partial images are printed, the larger amount the linear partial images may be displaced inward.

In view of this displacing phenomenon, according to the first modified example, a length L3 of the margin between the widthwise end of the recording sheet P and the image J, where the first linear partial image H1 is printed, may be smallest, and a length L4 of the margin between the widthwise end of the recording sheet P and the image J, where the last linear partial image HM is printed, may be largest. Further, a difference between the length L3 and a length L5 (i.e., L5–L3), which is a length of the margin between the widthwise of the recording sheet P and the linear partial image HY in the Y-th row, and a difference between the length L4 and L5 (i.e., L4–L5) may be smaller than a difference between the length L1 and the length L2 (i.e., L1–L2) (see FIG. 11A) according to the comparative example based on Formula 6. Therefore, according to the first modified example, an image, in which the inward or outward displacement with regard to the scanning direction may be less distinctive compared to an image to be printed in the comparative example, may be provided.

It may be noted that, in the first modified example, the cumulative value $\gamma_{(Y)}$ to calculate the correction time $F_{(1,n)}$ for the first row of path-printing operation is required prior to starting printing the first row. Therefore, the information concerning the duty for each block 61 for all the rows of path-printing operations may be obtained in S201, prior to starting the first path-printing operation for the first row. Thereafter, in S202, the correction parameters $\alpha_{(m,n)}$, $\beta_{(m,n)}$ for each block 61 in each row of the path-printing operations may be calculated.

Meanwhile, however, the correction time $F_{(m,n)}(x)$ may not necessarily be derived from the cumulative sum, in which the correction parameters $\beta_{(m,n)}$ are accumulated. For example, the correction time $F_{(m,n)}(x)$ may even be derived from Formula 6 described above. According to calculation derived from Formula 6, as has been described above, the images printed in two consecutive path-printing operations may be displaced from each other on the recording sheet P. Still, the correction parameter $\beta_{(m,n)}$ for the m-th row ($m \geq 2$) may be calculated in consideration of the shift of each position on the recording sheet P in the scanning direction due to the influence of the ink landed on the recording sheet P at the n-th block from the left in the earlier [m−1]th row. Further, the correction parameter $\beta_{(m,n)}$ may be calculated with reference to the duty in the n-th block 61 from the left in the [m−1]th row ($m \geq 2$). Therefore, even with the calculation based on Formula 6 described above, the ink-landing positions on the recording sheet P may be adjusted in the scanning direction still preferably, compared to the landing positions for the ink discharged at the discharging timing, which are calculated without considering the shift of each position on the recording sheet P in the scanning direction or of the moving amounts of the positions in the recording sheet P to move in the scanning direction due to the difference in duties.

For another example, the coefficient W may not necessarily depend on the aligning direction of the fiber in the recording sheet P, i.e., whether the aligning direction of the fiber is parallel or orthogonal to the scanning direction, to take the different values. For example, the coefficient W may take a value w1 when the recording sheet P is a first-typed sheet; and when the recording sheet P is a second-typed sheet, of which rigidity is lower than the first-typed sheet, the coefficient W may take a value w2. Each height and position in the scanning direction in the recording sheet P may tend to shift for a larger amount due to the rigidity change lowered by the influence of the ink landed on the recording sheet P when the rigidity of the recording sheet P is lower. Therefore, with the coefficient W determined by the rigidity of the recording sheet P, the ink may be discharged to land on the preferable positions on the recording sheet P responsively to the shift of each position in the recording sheet P in the scanning direction shifted by the influence of the ink landed on the recording sheet P. Moreover, the coefficient W may take different values depending on other characteristic of the recording sheet P than the fiber aligning direction or rigidity.

For another example, the coefficient Q may not necessarily depend on whether the flushing operation is conducted between the two path-printing operations for the [m−1]th row and the m-th row. If length of a time period between the path-printing operations for the [m−1]th row and the m-th row vary depending on a condition other than execution or absence of the flushing operation, the coefficient $Q_{(m-1)}$ may take different values depending on the condition. For example, when an amount of print data for a whole image is relatively large, such as print data for an image in higher resolution, by the time a path-printing operation to print a linear partial image for a row is completed, print data for a next row may not be completely transmitted to the controller 50. In such a case, the carriage 11 may be retracted to a position, where the ink discharging surface 12*a* of the inkjet head 12 should not face the recording sheet P, and pause temporality to wait for the print data for the next row to be received, with the ink discharging surface 12*a* covered with by a cap (not shown). Thus, if the pause is placed between the path-printing operations for the [m−1]th row and the m-th row, the time period between the path-printing operations for the [m−1]th row and the m-th row may be longer than a time period between path-printing operations for the [m−1]th row and the m-th row which are conducted consecutively without the pause. Therefore, in such a case, the coefficient $Q_{(m-1)}$ may take a different value depending on whether the pause is placed between the path-printing operations for the [m−1]th row and the m-th row. In this regard, the coefficient $Q_{(m-1)}$ should take a larger value when the time period between the path-printing operations for the [m−1]th row and the m-th row is longer.

For another example, the coefficient $T_{(n)}$ may not necessarily take the larger value for the blocks 61 on the outer side with regard to the scanning direction. As described above, when the recording sheet P is shaped into the corrugated form rippling up and down along the scanning direction by the pressers 14*a*, the ejection rollers 16, the ribs 20, and the corrugating spur wheels 17, the binding force from the pressers 14*a*, the ejection rollers 16, the ribs 20, and the corrugating spur wheels 17 to hold the recording sheet P may be smaller at the widthwise outer areas of the recording sheet P in the scanning direction than at the inner area of the recording sheet P. Therefore, for example, while the coefficient T takes a larger value for the outermost blocks 61, e.g., t1 and t16 (see FIG. 8C), than the values for the other blocks that are on the inner side, e.g., t2-t15, the coefficient T for the other blocks that are on the inner side may take a single value. Even with these values for the coefficient T, the ink may be discharged at preferable timing adjusted in accordance with the shift of each position in the recording sheet P, which may have been affected by the ink landing on the earlier path-printing operation, to land on each preferable position on the recording sheet P.

For another example, the parameter $B2_{(m-1,n)}$ to calculate the correction parameter $\beta_{(m,n)}$ for the n-th block 61 from the left in the m-th row, when the row is the subsequent row (m≥2), in Formula 4 described above, may not necessarily be derived from multiplication of the basic parameter $C_{(m-1,n)}$ by the coefficients $T_{(n)}$, $U_{(m-1,n)}$, $V_{(m-1)}$, W, and $Q_{(m-1)}$. For example, the basic parameter $C_{(m-1,n)}$ may be multiplied by one or more of the coefficients $T_{(n)}$, $U_{(m-1,n)}$, $V_{(m-1)}$, W, and $Q_{(m-1)}$ to calculate the correction parameter $\beta_{(m,n)}$. For another example, a value for the parameter $B2_{(m-1,n)}$ may depend on the duty in the n-th block from the left in the [m−1]th row alone regardless of the conditions concerning the coefficients $T_{(n)}$, $U_{(m-1,n)}$, $V_{(m-1)}$, W, or $Q_{(m-1)}$.

For another example, the value for the basic parameter $C_{(m-1,n)}$ may not necessarily be increased according to largeness of the duty in the n-th block 61 from the left in the [m−1]th row. The basic parameter $C_{(m-1,n)}$ may be determined with reference to a predetermined threshold value. That is, when the duty in the n-th block 61 from the left in the [m−1]th row is smaller than or equal to the threshold value, the basic parameter $C_{(m-1,n)}$ may take zero (0); and the value for the basic parameter $C_{(m-1,n)}$ may be increased to be larger according to the largeness of the duty as long as the duty exceeds to be greater than the threshold value. For example, in the embodiment described above, the threshold value may be 25%, and a value 0 may be assigned to c1 (c1=0).

For another example, the basic parameter $C_{(m-1,n)}$ may take zero (0) when the duty in the n-th block 61 from the left in the [m−1]th row is smaller than the threshold value; and when the duty in the n-th block 61 from the left in the [m−1]th row is greater than the threshold value, the basic parameter $C_{(m-1,n)}$ may take a constant value. For example, in the embodiment described above, the threshold value may be 25%; a value 0 may be assigned to c1 (c1=0); and the basic parameter $C_{(m-1,n)}$ may take the constant value (c2=c3=c4) as long as the duty exceeds 25%. In this case, in S201, in place of the information indicating the duty, information indicating whether the duty is lower or equal to or higher than the threshold value may be obtained.

For another example, the boundaries of each block 61 along the scanning direction may not necessarily be set at the positions coincident with one of the pressers 14*a* and one of the ribs 20 which adjoin each other. For example, the ink-dischargeable area 60 may be divided into a plurality of blocks along the scanning direction irrespectively of the positions of the ribs 20, the ejection rollers 16, the pressers 14*a*, or the corrugating spur wheels 17. Further, dimensions of the blocks 61 along the scanning direction may not necessarily be equal but may be different from one another.

For another example, the recording sheet P may not necessarily be shaped into the corrugated form.

Below will be described a second modified example of the embodiment. In the second modified example, as shown in FIGS. 12A-12B, a printer unit 101 does not have the corrugating plates 14 or the corrugating spur wheels 17 (see also FIGS. 3A-3B). Meanwhile, the recording sheet P is supported by a plurality of, e.g., eight (8), ribs 20 and a plurality of, e.g., eight (8), lower rollers 16*b* from below. In the second modified example, an ink-dischargeable area 102 is divided into a plurality of, e.g., seven (7), blocks 103, along the scanning direction. Boundaries of each block 103 along the scanning direction are located at positions coincident with one of the ribs 20 and one of the ejection rollers 16 which adjoin each other. In FIG. 12A, illustration of the conveyer roller 13 (see also FIG. 3A) is omitted for a purpose of expediency.

In the second modified example, when no ink is on the recording sheet P, as indicated by broken lines in FIGS. 12A-12B, the recording sheet P may lay flat in parallel with the scanning direction. In contrast, when the ink lands on the recording sheet P, rigidity of the recording sheet P may be lowered by the ink, and as indicated by dash-and-dots lines in FIGS. 12A-12B, height and each position in the scanning direction may shift. Therefore, in the second modified example, the correction parameters $\alpha_{(m,n)}$, $\beta_{(m,n)}$ are derived with reference to the duty in the path-printing operation for the [m−1]th row to calculate the correction time $F_{(m,n)}(x)$ based on Formula 2 described above. Thus, the ink may be discharged at preferable timing adjusted in accordance with the shift of each position in the recording sheet P, which may have been affected by the ink landing on the earlier path-printing operations, to land on each preferable position on the recording sheet P.

In the second modified example, further, height and each position in the scanning direction on the recording sheet P may shift due to lowered rigidity at intermediate positions between the adjoining ribs 20 and the ejection rollers 16 by the influence of the ink landed on the recording sheet P. Meanwhile, by providing the correction time $F_{(m,n)}(x)$ on basis of the block 103, of which boundaries along the scanning direction are located at the positions of one of the ribs and one of the ejection roller 16 that adjoin each other, the ink may be discharged at the timing adjusted to the shift of each position in the recording sheet P, which may have been affected by the ink landing on the earlier path-printing operation, to land on each preferable position on the recording sheet P.

While the recording sheet P may not necessarily be shaped into the corrugated form rippling up and down along the scanning direction, presser members to press the recording sheet P from above may still be provided. Below will be described a third modified example, with a plurality of presser members 112, with reference to FIG. 13.

As shown in FIG. 13, a printer unit 111 includes a configuration similar to the printer unit 101 in the second modified example. Further, the printer unit 111 includes the plurality of, e.g., nine (9), presser members 112 on an upstream side from the inkjet head 3 with regard to the conveying direction. The presser members 112 are arranged at rightward positions from a rightmost one of the ribs 20 and leftward positions from a leftmost one of the ribs 20, each at an intermediate position between adjoining ribs 20 along the scanning direction. Lower ends of the presser members 112 are at a position higher than or equal to a height of the upper ends of the ribs 20 to press the recording sheet P from above. A length L6 of a clearance between adjoining presser members 112 is shorter than a length L7 of each presser member 112 along the scanning direction. The presser members 112 in this arrangement may prevent the recording sheet P from floating upward and from colliding with the ink discharging surface 12*a*.

Although examples of carrying out the invention has been described, those skilled in the art will appreciate that there are numerous variations and permutations of the liquid discharging device that fall within the spirit and scope of the invention as set forth in the appended claims.

For further example, the correction parameters and the correction time may not necessarily be calculated on the block 61 basis but may be calculated on basis of a row of path-printing operation, irrespectively of positions in the scanning direction. In this regard, in place of the correction parameters $\alpha_{(m,n)}$, $\beta_{(m,n)}$ described above, correction parameters $\alpha_{(m)}$, $\beta_{(m)}$, which are constant throughout the row of path-printing operation, may be calculated for the path-printing operation in the m-th row with reference to the duty caused in path-printing operation for the [m−1]th row. Thus, based on the correction parameters $\alpha_{(m)}$, $\beta_{(m,n)}$, the correction time $F_{(m)}(x)$ irrespective of the positions in the scanning direction may be calculated.

For another example, in S201 (see FIG. 7), the controller 50 may not necessarily obtain the information concerning the duty to obtain information concerning an amount of the ink discharged in an earlier path-printing operation but may obtain, for example, a volume of the discharged ink, or any another form of information concerning an amount of the ink, discharged in the earlier path-printing operation.

For another example, the discharging timing to discharge the ink through the nozzles 10 may not necessarily be delayed or advanced from the reference timing depending on a position of the block 60 in the scanning direction with reference to the center 60*a*. That is, in the embodiment described above, the discharging timing is delayed from the reference timing, when the block 60 is on the upstream side of the center 60*a* in the ink-dischargeable area 60 with regard to the moving direction of the carriage 11 ($[\beta_{(m,n)}]\times x>0$) in the path-printing operation, and is advanced from the reference timing when the block 60 is on the downstream side of the center 60*a* with regard to the moving direction of the carriage 11 ($[\beta_{(m,n)}]\times x<0$). However, the reference position may not necessarily be set at the center 60*a* in the ink-dischargeable area 60 but may be set at a position displaced from the center 60*a* leftward or rightward.

For another example, the inkjet printer 1 described in the embodiment above may not necessarily be configured as a multifunction peripheral device having the printer unit 2 and the reader unit 5 but may be a single-functioned printer having no reader unit 5.

For another example, the embodiment described above may not necessarily be applied to an inkjet printer, in which the ink is discharged through the nozzles to print an image on the recording sheet P, but may be similarly applied to a liquid ejecting device that may eject liquid through nozzles at a sheet.

It is to be understood that the subject matter defined in the appended claims may not necessarily be limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

What is claimed is:

1. A liquid discharging device, comprising:

a liquid discharging head comprising a plurality of nozzles and a liquid discharging surface, on which the plurality of nozzles are arranged;

a carriage, on which the liquid discharging head is mounted;

a carriage movement mechanism configured to reciprocally move the carriage in a carriage-movable direction along a predetermined line;

a sheet conveyer configured to convey a sheet in a conveying direction, the conveying direction intersecting with the carriage-movable direction; and a controller configured to control the liquid discharging head, the carriage movement mechanism, and the sheet conveyer to perform printing of an image on the sheet, the image comprising a plurality of image rows, the printing comprising a path-printing and a conveying, the path-printing and the conveying are repeated alternately for a plurality of times, in the path-printing, the controller manipulating the carriage to move in the carriage-movable direction and the liquid discharging head to discharge the liquid through the plurality of nozzles to form each image row, and in the conveying the controller manipulating the sheet conveyer to convey the sheet for a predetermined distance along the conveying direction after completion of the path-printing for an image row, wherein, in the printing, the controller is configured to:

obtain discharged amount information concerning a discharged amount of the liquid discharged at the sheet in the path-printing for each image row;

determine a correction parameter to correct a discharging timing to discharge the liquid at a position on the sheet through the plurality of nozzles based on the discharged amount information for the path-printing for each image row and based on the position on the sheet in one of a first direction and a second direction with respect to a predetermined reference position, where the discharging timing is delayed by a greater length of time from a predetermined reference timing as a distance from the predetermined reference position to the position on the sheet in the first direction increases and where the discharging timing is advanced by a greater length of time from the predetermined reference timing as a distance from the predetermined reference position to the position on the sheet in the second direction increases, the first direction extending in an opposite direction as the second direction, the second direction being the direction of movement of the carriage for the image row; and calculate the discharging timing to discharge the liquid based on the correction parameter for the path-printing for each image row;

wherein, the plurality of image rows comprises a first image row, a second image row and a third image row, the first image row being an image row that is printed first, the second image row being an image row that is printed subsequent to the first image row, the third image row being an image row that is printed adjacent to the second image row and printed before the second image row, wherein, when determining the correction parameter for the path-printing for the second image row, if the discharged amount of the liquid discharged at the sheet in the path-printing for the third image row is greater than a predetermined threshold amount, the controller determines a value for the correction parameter for the path-printing for the second image row based on the predetermined reference timing:

where for an area on the sheet within the second image row located at a position at a distance from the predetermined reference position in the first direction, the discharging timing is delayed by a greater length of time from the predetermined reference timing than the discharging timing for the same area, when the discharged amount of the liquid discharged at the sheet in the path-printing for the third image row is smaller than or equal to the predetermined threshold amount; and where for an area on the sheet within the second image row located at a position at a distance from the predetermined reference position in the second direction, the discharging timing is advanced for a greater length of time from the predetermined reference timing than the discharging timing for the same area, when the discharged amount of the liquid discharged at the sheet in the path-printing for the third image row is smaller than or equal to the predetermined threshold amount.

2. The liquid discharging device according to claim 1, wherein when the discharged amount of the liquid discharged at the sheet in the path-printing for the third image row is a first amount being greater than the predetermined threshold amount, the controller determines the value for the correction parameter for the path-printing for the second image row:

where for an area on the sheet within the second image row located at a position at a distance from the predetermined reference position in the first direction, the discharging timing is delayed by a greater length of time from the predetermined reference timing than the discharging timing for the same area, when the discharged amount of the liquid discharged at the sheet in the path-printing for the third image row is a second amount being greater than the predetermined threshold amount and smaller than the first amount; and where for an area on the sheet within the second image row located at a position at a distance from the predetermined reference position in the second direction, the discharging timing is advanced by a greater length of time from the predetermined reference timing than the discharging timing for the same area, when the discharged amount of the liquid discharged at the sheet in the path-printing for the third image row is the second amount.

3. The liquid discharging device according to claim 1, wherein the liquid discharging head is configured to discharge the liquid at a liquid-dischargeable area in the sheet, the liquid dischargeable area being divided along the carriage-movable direction into a plurality of blocks, wherein the controller obtains the discharged amount information concerning the discharged amount of the liquid discharged at each of the plurality of blocks, wherein the controller determines the value for the correction parameter for each of the plurality of blocks based on the discharged amount information concerning each of the plurality of blocks in the path-printing for the third image row and based on the position on the sheet with respect to the predetermined reference position, and wherein the controller calculates the discharging timing to discharge the liquid at each of the plurality of blocks based on the correction parameter determined for each of the plurality of blocks.

4. The liquid discharging device according to claim 3, wherein the plurality of blocks comprises a first block located at least partly at a position at a first distance from the predetermined reference position in the first direction and a second block located at a position at a second distance from the predetermined reference position in the first direction, the second distance being a greater distance from the predetermined reference position than the first distance in the first direction;

wherein the controller determines the value for the correction parameter for the second block based on the discharged amount information concerning the second block in the path-printing for the third image row by delaying the discharging timing by a greater length of time from the predetermined reference timing than a discharging timing for the first block derived from the same discharged amount information.

5. The liquid discharging device according to claim 4, wherein the plurality of blocks comprises a block located at least partly at a position at a third distance from the predetermined reference position in the second direction and another block located at a position at a fourth distance from the predetermined reference position in the second direction, the fourth distance being a greater distance from the predetermined reference position than the third distance in the second direction;

wherein the controller determines the value for the correction parameter for the another block based on the discharged amount information concerning the another block in the path-printing for the third image row by advancing the discharging timing by a greater length of time from the predetermined reference timing than a discharging timing for the block derived from the same discharged amount information.

6. The liquid discharging device according to claim 3, wherein the plurality of blocks comprises a block located at least partly at a position at a third distance from the predetermined reference position in the second direction and another block located at a position at a fourth distance from the predetermined reference position in the second direction, the fourth distance being a greater distance from the predetermined reference position than the third distance in the second direction;

wherein the controller determines the value for the correction parameter for the another block based on the discharged amount information concerning the another block in the path-printing for the third image row by advancing the discharging timing by a greater length of time from the predetermined reference timing than a discharging timing for the block derived from the same discharged amount information.

7. The liquid discharging device according to claim 3, further comprising a plurality of presser members arranged along the carriage-movable direction to be spaced apart from one another, the plurality of presser members being configured to press the sheet being conveyed by the sheet conveyer from a side of the liquid-discharging surface; and a plurality of supporting members arranged along the carriage-movable direction each alternately with the plurality of presser members, the plurality of supporting members being configured to support the sheet being conveyed by the sheet conveyer at a position closer than the plurality of presser members to the liquid-discharging surface from an opposite side of the sheet from the liquid-discharging surface, wherein boundaries of each of the plurality of blocks along the carriage-movable direction are located at positions coincident with one of the plurality of presser members and one of the plurality of supporting members adjoining the one of the plurality of presser members.

8. The liquid discharging device according to claim 3, further comprising:

a plurality of supporting members arranged along the carriage-movable direction to be spaced apart from one another, the plurality of supporting members being configured to support the sheet being conveyed by the sheet conveyer from an opposite of the sheet from the liquid- discharging surface, wherein boundaries of each of the plurality of blocks along the carriage-movable direction are located at positions coincident with one and another of the plurality of supporting members that adjoin each other.

9. The liquid discharging device according to claim 1, further comprising:

a corrugating shape generator arranged on a downstream side of the liquid discharging head with regard to the conveying direction, the corrugating shape generator being configured to generate a corrugated shape along the carriage-movable direction in the sheet being conveyed by the sheet conveyer, wherein when at least a leading end of the sheet being conveyed has reached the corrugating shape generator before the path-printing for the third image row is conducted, the controller determines the value for the correction parameter for an area on the sheet within the second image row located at a position at a distance from the predetermined reference position in the first direction in the path-printing for the second image row by:

delaying the discharging timing by a greater length of time from the predetermined reference timing than the discharging timing for the same area, when the leading end of the sheet being conveyed did not reach the corrugating shape generator before the path-printing for the third image row; and advancing the discharging timing by a greater length of time from the predetermined reference timing than the discharging timing for an area on the sheet within the second image row located at a position at a distance from the predetermined reference position in the second direction, when the leading end of the sheet being conveyed did not reach the corrugating shape generator before the path-printing for the third image row.

10. The liquid discharging device according to claim 1, wherein the controller calculates the discharging timing for a path-printing for the second image-or-subsequent image row, which is to be conducted subsequent to a path-printing for an image row that is adjacent to the first image row, based on the correction parameter using a cumulative sum, in which the correction parameter for each of the path-printing for the image rows that precede the path-printing for the second image-or-subsequent image row is accumulated.

11. The liquid discharging device according to claim 10, wherein the controller determines the correction parameter for each of the path-printing for the image rows prior to conducting the path-printing for the first image row;

wherein the controller calculates the discharging timing for each of the path-printing for the image rows based on the correction parameter using the cumulative sum, from which a value of the correction parameter for one of the path-printing for an image row to discharge the liquid at a central area in the sheet with regard to the conveying direction is subtracted.

12. The liquid discharging device according to claim 1, wherein the path-printing for the second image row comprises:

a first path-printing operation to be activated after a first length of time since completion of the path-printing for the third image row; and a second path-printing operation to be activated after a second length of time longer than the first length since completion of the path-printing for the third image row;

wherein the controller determines the value for the correction parameter for the second path-printing operation:

where for an area on the sheet within the second image row located at a position at a distance from the predetermined reference position in the first direction, the discharging timing is delayed by a greater length of time from the predetermined reference timing than the discharging timing for the same area in the first path-printing operation; and where for an area on the sheet within the second image row located at a position at a distance from of the predetermined reference position in the second direction, the discharging timing is advanced by a greater length of time from the predetermined reference timing than the discharging timing for the same area in the first path-printing operation.

13. The liquid discharging device according to claim 1, wherein the sheet conveyer is configured to convey a plurality of different types of sheets including a first-typed sheet and a second-typed sheet;

wherein the controller determines a different value for the correction parameter depending on the type of the sheet being conveyed between the first-typed sheet and the second-typed sheet.

14. The liquid discharging device according to claim 13, wherein the sheet conveyer is configured to convey the first-typed sheet in an alignment with fiber therein aligned in parallel with the carriage-movable direction and the second-typed sheet in an alignment with the fiber therein intersecting with the carriage-movable direction;

wherein the controller determines the value for the correction parameter:

where for an area on the sheet located at a position at a distance from the predetermined reference position in the first direction, the discharging timing is delayed by a greater length of time from the predetermined reference timing than the discharging timing for the same area in the first-typed sheet; and where for an area on the sheet located at a position at a distance from the predetermined reference position in the second direction, the discharging timing is advanced by a greater length of time from the predetermined reference timing than the discharging timing for the same area in the first-typed sheet.

15. The liquid discharging device according to claim 1, wherein the plurality of nozzles comprise a plurality of types of nozzles, through which different-typed liquids are dischargeable;

wherein the controller obtains the discharged amount of the liquid discharged through each of the plurality of types of nozzles in each of the path-printing for image rows; and wherein the controller determines the value for the correction parameter based on a sum of the discharged amounts of the plurality of different-typed liquids and a ratio of the discharged amounts of the different-typed liquids with respect to the sum of the discharged amounts of the plurality of different-typed liquids.

16. The liquid discharging device according to claim 1, wherein the liquid discharging head is configured to discharge the liquid at a liquid-dischargeable area in the sheet, and wherein the predetermined reference position is at a center of the liquid-dischargeable area in the carriage-movable direction.

* * * * *